US006459417B1

(12) United States Patent
Orisaka et al.

(10) Patent No.: US 6,459,417 B1
(45) Date of Patent: Oct. 1, 2002

(54) DISPLAY DRIVING DEVICE AND LIQUID CRYSTAL MODULE USING THE SAME

(75) Inventors: Yukihisa Orisaka; Yoshinori Ogawa, both of Yamatotakada (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/546,344

(22) Filed: Apr. 10, 2000

(30) Foreign Application Priority Data

Sep. 30, 1999 (JP) ..... 11-279685
Dec. 21, 1999 (JP) ..... 11-362976

(51) Int. Cl.[7] ..... G09G 3/00
(52) U.S. Cl. ..... 345/98; 345/100
(58) Field of Search ..... 345/89, 98, 100

(56) References Cited

U.S. PATENT DOCUMENTS 5,191,450 A * 3/1993 Yajima et al. ..... 359/54
5,325,411 A 6/1994 Orisaka ..... 377/55
5,465,053 A * 11/1995 Edwards ..... 324/770
5,717,351 A * 2/1998 Katsutani ..... 327/108
5,757,353 A * 5/1998 Yokota et al. ..... 345/123
5,828,357 A 10/1998 Tamai et al. ..... 345/89
5,874,934 A * 2/1999 Ito ..... 345/98
6,002,384 A 12/1999 Tamai et al. ..... 345/95
6,011,533 A * 1/2000 Aoki ..... 345/92

FOREIGN PATENT DOCUMENTS

JP 9-160526 6/1997
JP 10-74060 3/1998
KR 002050858 3/2002

* cited by examiner

*Primary Examiner*—Amare Mengistu

(57) ABSTRACT

A display driving device of the present invention includes: a group of source drivers having a bidirectional shift register and made up of a plurality of serially connected source drivers; and a start pulse signal as a single supply line, which is branched into two systems for supplying an externally supplied start pulse signal to each source driver, wherein the two systems of the branched single supply line are respectively connected to input terminals of the start pulse signal of source drivers at the both ends of the group of source drivers, and a transfer direction of the start pulse signal is switched with the single supply line by making one of the two systems of the start pulse signal conductive while making the other non-conductive within the group of source drivers.

16 Claims, 17 Drawing Sheets

DISPLAY DRIVING DEVICE AND LIQUID CRYSTAL MODULE USING THE SAME

FIELD OF THE INVENTION

The present invention relates to a driving device for driving an image display element, and particularly relates to a connection mode and signal supply mode of a liquid crystal driver to be mounted as a source driver or gate driver on a liquid crystal module.

BACKGROUND OF THE INVENTION

The following will describe a system structure of a display driving device of a conventional liquid crystal module referring to FIG. 14.

As shown in FIG. 14, as a driving device for driving source bus lines of a liquid crystal panel 100, there are provided n source drivers S (will be referred to as "group of source drivers S" hereinafter where appropriate) which are realized by source driver LSIs (Large Scale Integrated Circuits) each having a bidirectional shift register. The source drivers S are mounted on a liquid crystal panel 100 by being mounted on their corresponding TCP (Tape Carrier Package) 101. The source drivers S are serially connected to one another to supply various signals such as start pulse signal SPD and clock signal CK, which are to be described later.

Each TCP 101 mounting a source driver S is electrically connected to the input terminal (not shown) of the liquid crystal panel 100 by its output terminal for the liquid crystal panel 100, and the input terminal of the TCP is electrically connected to the wiring provided on a print substrate 102, by which the liquid crystal panel 100 and print substrate 102 are electrically connected to each other via the group of source drivers S.

Controller 104 is connected to the print substrate 102 on the side of the source driver S(1). The controller 104 is for supplying control signals and power to the group of source drivers S, and the control signals and power are supplied to each source driver S via wiring on the print substrate 102 and wiring on TCP 101. Note that, although not shown, the controller 104 also supplies control signals and power to a group of gate drivers.

The control signals and power supplied from the controller 104 include: start pulse signal SPD which is in synchronism with a horizontal synchronize signal of a video signal; clock signal CK; video signal Video; switch signal RL for deciding a transfer direction of the start pulse signal SPD in the source drivers S by switching a bidirectional shift register and input/output buffers of each source driver S, and power VCC and GND, etc.

In the structure of FIG. 14, the clock signal CK, video signal Video, switch signal RL, power VCC and GND supplied from the controller 104 are inputted to the first source driver S(1) via input terminal CK1, input terminal Video 1, input terminal RL1, power terminal VCC, and power terminal GND, respectively. By transferring through inner wiring made of, for example, aluminium in the source driver S(1), these signals are then outputted from the source driver S(1) via output terminal CK2, output terminal Video 2, output terminal RL2, output terminal VCC, and output terminal GND, respectively, to be inputted in the same manner to the source driver S(2) of the next stage.

Note that, the supply lines of the signals supplied from the controller 104 may be provided as a common line by the wiring on the print substrate 102 so that the signals are individually inputted to each source driver S.

Meanwhile, as shown in FIG. 14, there are provided two lines for the start pulse signal SPD, one entering the input/output terminal SPD1 of the first source driver S(1), and one entering the input/output terminal SPD2 of the nth source driver S(n), and input is made by selecting one of the lines. By selecting the input/output terminal SPD1 or input/output terminal SPD2 to which the start pulse signal SPD is to be inputted, the transfer direction of the start pulse signal SPD within the group of source drivers S is switched either from the source driver S(1) to the source driver S(n), or from the source driver S(n) to the source driver S(1). This selection of line for inputting the start pulse signal SPD is carried out by the controller 104.

On the start pulse signal output stage of the controller 104, there are provided switches SW1 and SW2 such as analog switches which are switched under the control of control signal SPA (/SPA is an inverted signal of SPA), and selection of line for outputting the start pulse signal SPD is realized by the switching control of the switches SW1 and SW2.

When inputting through input/output terminal SPD1, the control signal SPA is set at "High" level. When the control signal SPA is at "High" level, the switch SW1 on the side of SPD1 is closed, and the switch SW2 on the side of SPD2 is opened. On the other hand, when inputting through input/output terminal SPD2, the control signal SPA is set at "Low" level. When the control signal SPA is at "Low" level, the switch SW1 on the side of SPD1 is opened, and the switch SW2 on the side of SPD2 is closed.

When the control signal SPA is at "High" level, the start pulse signal SPD is inputted from the input/output terminal SPD1 of the source driver S(1) in synchronism with the clock signal CK, and by transferring through the bidirectional shift register in the source driver S(1), the signal is inputted into the source driver S(2) of the next stage and transferred subsequently to the source driver S(n) of the last stage through the serially connected source drivers S. Here, even though the start pulse signal SPD is outputted from the input/output terminal SPD2 of the source driver S(n) of the last stage, because input is made from SPD1 and the switch SW2 of the controller 104 is open, the start pulse signal SPD is not transferred to the controller 104.

On the other hand, when the control signal SPA is set at "Low" level, the start pulse signal SPD is inputted to the input/output terminal SPD2 of the nth source driver S(n), which in this case is on the first stage, and the signal is transferred to the first source driver S(1), which in this case is on the last stage. As with the above case, even though the start pulse signal SPD is outputted from the input/output terminal SPD1 of the source driver S(1) of the last stage, because input is made from SPD2 and the switch SW1 of the controller 104 is open, the signal is not transferred to the controller 104. Further, in this case, the level of switch signal RL for deciding the transfer direction of the start pulse signal SPD in each source driver S is also set inversely.

The following will describe the system structure of FIG. 14 in more detail referring to the block diagram of FIGS. 15(*a*) and 15(*b*). In FIGS. 15(*a*) and 15(*b*), OS1 to OSm are output terminals to the liquid crystal panel 100 from each source driver S.

In FIG. 15(*a*), the control signal SPA of the switches SW1 and SW2 in the controller 104 is at "High" level and the switch SW1 on the side of SPD1 is closed. In this state, the start pulse signal SPD is inputted to the input/output terminal SPD1 of the source driver S(1) and it is outputted from the input/output terminal SPD2 to be inputted to the input/output terminal SPD1 of the source driver S(2) on the next stage, and the signal is transferred subsequently in the same manner.

In FIG. 15(*b*), the level of control signal SPA of the switches SW1 and SW2 and the level of switch signal RL are set inversely, and the transfer direction of the start pulse signal SPD is reversed. That is, in FIG. 15(*b*), the start pulse signal SPD is inputted from the input/output terminal SPD2 of the nth source driver S(n) and is outputted from the input/output terminal SPD1 to be inputted to the source driver S(n−1) of the next stage, and the signal is subsequently transferred to the first source driver S(1) in the same manner.

FIGS. 16(*a*) and 16(*b*) show an example in which the line connected to the input/output terminal SPD1 of the source driver S(n) is directly connected to the controller 104 via wiring on TCP 011 and wiring on the print substrate 102 (in FIGS. 15(*a*) and 15(*b*), the line connected to the input/output terminal SPD2 of the source driver S(n) is directly connected to the controller 104 via wiring on TCP 101 and wiring on the print substrate 102). FIG. 17 shows a structure of the liquid crystal module corresponding to FIG. 16.

By taking this measure, i.e., by making the transfer direction of the start pulse signal SPD switchable by the bidirectional shift register which is provided as the shift register of each source driver S, the same source drivers S may be provided either on the upper side or lower side of the liquid crystal panel 100, thus reducing the cost of the source drivers S as the driving semiconductor elements.

Further, even when viewed as a liquid crystal module, whether to mount the controller 104 for outputting the start pulse signal on the left or right side of the group of source drivers S can be decided flexibly by making the transfer direction of the start pulse signal switchable, allowing the controller 104 to be provided either on the left side or right side of the group of source drivers S regardless of whether the group of source drivers S are provided on the upper side or lower side of the liquid crystal panel 100, thus making it easier to design a smaller and thinner module.

Further, as shown in FIG. 14 and FIG. 17, the same print substrate 102 can be provided regardless of whether the source drivers S are provided on the upper side or lower side of the liquid crystal panel 100.

However, in recent years, there has been increasing demand for a smaller, thinner, and less expensive liquid crystal module, and effort has been made to meet this demand from a view point of the liquid crystal module as a whole. Therefore, study must focus not only on the source drivers S and gate drivers but also on the controller 104.

As such, to meet such demand, the applicant of the present application sought any possible improvement in the structure of the conventional liquid crystal module, and after extensive research, found that improvements can be made in the following domains.

Namely, in the conventional structure as described above, to enable switching of a transfer direction of the start pulse signal SPD by the bidirectional shift register in the source drivers S, the controller 104 has two lines, one connected to the input/output terminal SPD1 (or input/output terminal SPD2) of the source driver S(1) on the first stage, and one connected to the input/output terminal SPD2 (or input/output terminal SPD1) of the nth source driver S(n). As a result, the number of wires between the controller 104 and the group of source drivers S is increased, and miniaturization of the module is prevented inevitably.

Further, in the described arrangement, input of the start pulse signal SPD is selected by the provision of the switches SW1 and SW2 such as analog switches in the controller 104, which are closed and opened in accordance with control signal SPA. As a result, the structure on the side of the controller 104 is made complex, and because the signals are separately outputted to the side of the input/output terminal SPD1 and to the side of the input/output terminal SPD2 via switches SW1 and SW2, the number of terminals of LSIs on the side of the controller 104 is increased, preventing the size and cost of the controller 104 from being reduced.

Note that, even though the above description is based on the group of source drivers, evidently, the same problems are also presented in a group of gate drivers which drive gate bus lines of a display device.

SUMMARY OF THE INVENTION

It is an object of the present invention to provide a display driving device which can reduce the number of terminals of LSIs on the side of a controller, and the number of wires between the controller and a group of driving semiconductor elements, and, in turn, the number of means provided, such as switches, in the controller.

In order to achieve the foregoing object, a display driving device of the present invention includes: a group of driving semiconductor elements including a bidirectional shift register and made up of a plurality of serially connected driving semiconductor elements; and a single supply line which is branched into two systems for supplying an externally supplied start pulse signal to each driving semiconductor element, wherein the two systems of the branched single supply line are respectively connected to input terminals of the start pulse signal of driving elements at the both ends of the group of driving semiconductor elements, and a transfer direction of the start pulse signal is switched with the single supply line by making one of the two systems of the start pulse signal conductive while making the other non-conductive within the group of driving semiconductor elements.

With this arrangement, there is provided only a single supply line for an externally supplied start pulse signal, and this single supply line is branched into two systems to be respectively connected to the input terminals of the start pulse signal of driving semiconductor elements at the both ends of the group of serially connected driving semiconductor elements so as to conduct one of the start pulse signals in the group of driving semiconductor elements.

Thus, it is possible to provide a display driving device which can switch the transfer direction of the start pulse signal without the conventional switching operation between conductive and non-conductive states by the provision of means such as analog switches on the side of the controller which inputs a control signal and other signals to the group of driving semiconductor elements.

Further, by setting a transfer direction of the start pulse signal in accordance with a transfer direction of a data signal, as described above, the same driving semiconductor elements can be mounted either on the upper side or lower side of the liquid crystal panel, and also the controller can be mounted either on the right side or left side of the driving semiconductor elements, regardless of whether the driving semiconductor elements are mounted on the upper side or lower side of the liquid crystal panel. Thus, because one kind of driving semiconductor elements can be positioned variably, the cost of driving semiconductor elements can be reduced.

Further, in this case, because the arrangement in which the transfer direction of the start pulse signal is switchable can be realized with less number of circuits on the side of the controller and less number of semiconductor device terminals to be provided on the side of the controller as compared with the conventional arrangement, the size and cost of the liquid crystal module can be further reduced.

Furthermore, because only a single line is required for the wiring between the controller and the group of driving semiconductor elements, compared with the conventional arrangement in which two lines were provided, in addition to reducing the size of the liquid crystal module, the adverse effect of noise can be reduced by widening the pitch of the wiring pattern which became narrow by the reduction in size of the liquid crystal module. Further, because only a single line is required for the wiring from the controller, there will be no change in wiring pattern due to a positioning relationship between the controller and the group of driving semiconductor elements, thus making designing of the module easier.

In order to achieve the foregoing object, another display driving device of the present invention includes: a single driving semiconductor element including a bidirectional shift register; and a single supply line which is branched into two systems for supplying an externally supplied start pulse signal to the driving semiconductor element, wherein the two systems of the branched start pulse signal are respectively connected to input terminals of the start pulse signal at the both ends of the driving semiconductor element, and a transfer direction of the start pulse signal is switched with the single supply line by making one of the two systems of the start pulse signal conductive while making the other non-conductive within the driving semiconductor element.

Even though the display driving device having the above arrangement incorporates only a single driving semiconductor element, by providing a single supply line for the start pulse signal, the same functions and effects as that of the previously described display driving device having a plurality of driving semiconductor elements can be obtained.

In order to achieve the foregoing object, yet another display driving device of the present invention which is capable of switching a transfer direction of a start pulse signal includes: a group of driving semiconductor elements including a bidirectional shift register and made up of a plurality of serially connected driving semiconductor elements; and an input/output buffer which is provided for each of input and output terminals of the start pulse signal of each driving semiconductor element, and which is capable of switching input and output by an externally supplied switch signal, wherein the start pulse signal is supplied to both of connected terminals of an input terminal of the start pulse signal of a driving semiconductor element on a first stage with respect to a transfer direction of a data signal and an output terminal of the start pulse signal of a driving semiconductor element on a last stage with respect to the transfer direction of the data signal, and a signal is prevented from being outputted from the output terminal of the start pulse signal of the driving semiconductor element on the last stage.

With this arrangement, the input terminal of the start pulse signal of the driving semiconductor element on the first stage with respect to the transfer direction of the data signal is connected to the output terminal of the start pulse signal of the driving semiconductor element on the last stage, and the start pulse signal is supplied to both of these connected terminals. In this case, by simply connecting the input terminal of the start pulse signal of the driving semiconductor element on the first stage and the output terminal of the start pulse signal of the driving semiconductor element on the last stage, there occurs a collision of start pulse signals. However, with the described arrangement, this is not a problem since a signal is prevented from being outputted from the input/output buffer of the output terminal of the start pulse signal of the driving semiconductor element on the last stage.

Thus, as with the previously described display driving device, the functions and effects of the single supply line of the start pulse signal can be obtained.

Incidentally, signal output from the output terminal of the start pulse signal of the driving semiconductor element on the last stage can also be prevented, for example, by cutting the output line. However, in such a case, the TCP pattern, etc., may need to be changed when changing the transfer direction of the start pulse signal or depending on the position of the controller with respect to the group of source drivers (group of driving semiconductor elements), and as a result the cost is increased and the convenience of liquid crystal module designing suffers.

Thus, the arrangement in which signal output from the output terminal of the start pulse signal of the driving semiconductor element on the last stage is prevented is preferably arranged such that the output buffer circuit of the input/output buffer of the output terminal sets the output terminal at "High" impedance state. With this arrangement, the operation of the output buffer circuit can be controlled with the use of a power voltage as a set signal of a logic gate provided in the output buffer circuit within the driving semiconductor elements, and thus this arrangement has the following advantages.

First, a "High" impedance state can easily be brought about only by adding a set signal compatible circuit in a conventional input/output buffer. This only results in minute increase in number of circuit elements and can be realized with ease and the chip area will not be increased. Further, because it can be realized only by changing the TCP pattern, only one kind of driving semiconductor element is required, and it is cost efficient. Further, switching can easily be made only by inputting a power (VCC, GND) level, allowing a simple arrangement. Furthermore, because the arrangement can easily be realized by internal circuits without requiring external circuits, it has the advantage of reliability and manufacturing cost.

In order to achieve the foregoing object, still another display driving device of the present invention which is capable of switching a transfer direction of a start pulse signal includes: a single driving semiconductor element including a bidirectional shift register; and an input/output buffer, which is provided for each of input and output terminals of the start pulse signal of the driving semiconductor element, and which is capable of switching input and output by an externally supplied switch signal, wherein the input and output terminals of the start pulse signal of the driving semiconductor element are connected to each other, and the start pulse signal is supplied to both of the input and output terminals, and a signal is prevented from being outputted from the input/output buffer of one of the terminals to be an output terminal of the start pulse signal with respect to a transfer direction of a data signal.

Even though the display driving device having the above arrangement incorporates only a single driving semiconductor element, by having the same arrangement as that of the previously described display driving device, the same functions and effects as that of the previously described display driving device can be obtained.

In order to achieve the foregoing object, yet another display driving device of the present invention which is capable of switching a transfer direction of a start pulse signal includes: a group of driving semiconductor elements including a bidirectional shift register and made up of a plurality of serially connected driving semiconductor elements, wherein two systems of input and output terminals of the start pulse signal are provided for each driving semiconductor element, and a single supply line for externally supplying the start pulse signal is connected to each of the input terminals of the start pulse signal of driving semiconductor elements at the both ends of the group of driving semiconductor elements by being branched into two systems.

With this arrangement, there are provided two systems of input and output terminals of the start pulse signal for each driving semiconductor element, and a supply line of the start pulse signal is connected to each of the input terminals of the start pulse signal of the driving semiconductor elements at the both ends of the group of serially connected driving semiconductor elements.

Thus, as with the previously described display driving device, the functions and effects of a single supply line of the start pulse signal can be obtained.

Further, with this arrangement, only one of the start pulse signals inputted into the group of driving semiconductor elements from the both ends is conducted, and the output terminal of the driving semiconductor element on the last stage of the transfer direction has an free end, and therefore unlike the previously described display driving device, it is not required to control the operation of the input/output buffer. As a result, it is not required to provide a signal line or other lines for controlling the operation of the input/output buffer, thus making designing of TCP, etc., mounting the driving semiconductor elements easier.

In order to achieve the foregoing object, a display driving device of the present invention which is capable of switching a transfer direction of a start pulse signal includes: a single driving semiconductor element including a bidirectional shift register, wherein two systems of input and output terminals of the start pulse signal are provided for the driving semiconductor element, and a single supply line for externally supplying the start pulse signal is connected to each of the input terminals of the start pulse signal of the driving semiconductor element by being branched into two systems.

Even though the display driving device having the above arrangement incorporates only a single driving semiconductor element, by having the same arrangement as that of the previously described display driving device, the same functions and effects as that of the previously described display driving device can be obtained.

For a fuller understanding of the nature and advantages of the invention, reference should be made to the ensuing detailed description taken in conjunction with the accompanying drawings.

BRIEF DESCRIPTION OF THE DRAWINGS

FIG. 3(*b*) is a block diagram showing an example of how a start pulse signal is supplied in the liquid crystal module of FIG. 1.

FIG. 4(*b*) is a block diagram showing how a start pulse signal is supplied in a liquid crystal module employing a single source driver, showing another embodiment of the present invention.

FIG. 6(*b*) is a block diagram showing an example of how a start pulse signal is supplied in the group of source drivers of the liquid crystal module of FIG. 5.

FIG. 7(*b*) is a block diagram showing an example of how a start pulse signal is supplied in a liquid crystal module employing a single source driver, showing another embodiment of the present invention.

FIG. 11(*b*) is a block diagram showing transfer paths of a start pulse signal through plural source drivers.

FIG. 12(*b*) is a block diagram showing transfer paths of a start pulse signal through plural source drivers.

FIG. 13(*b*) is a block diagram showing transfer paths of a start pulse signal through a single source driver.

FIG. 15(*b*) is a block diagram showing an example of how a start pulse signal is supplied in the liquid crystal module of FIG. 14.

FIG. 16(*b*) is a block diagram showing an example of how a start pulse signal is supplied in the liquid crystal module of FIG. 17.

DESCRIPTION OF THE EMBODIMENTS

First Embodiment

The following will describe one embodiment of a display driving device of the present invention and a liquid crystal module of the present invention employing such a display driving device referring to FIG. 1 through FIG. 7. Note that, even though the following description is based on the case where a group of source drivers are employed as an example of the display driving device, evidently, the features of the display driving device and the liquid crystal module employing such a display driving device are also applicable to a group of gate drivers.

Figure 1:
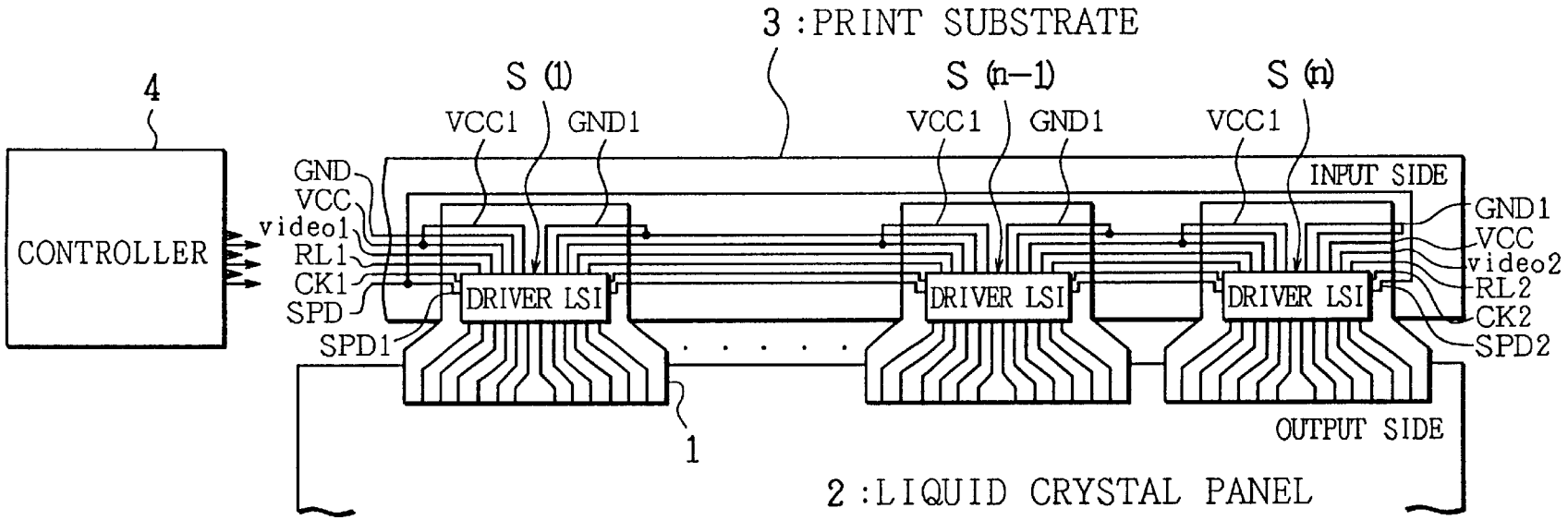
FIG. 1 is a plan view showing a structure of a liquid crystal module employing plural source drivers, showing one embodiment of the present invention.

FIG. 1 shows a system structure of a display driving device of a liquid crystal module of the present embodiment. As shown in FIG. 1, as a driving device for driving source bus lines, there are provided n source drivers S (will be referred to as "group of source drivers S" hereinafter where appropriate) which are realized by source driver LSIs each having a bidirectional shift register. The source drivers S are mounted on a liquid crystal panel 2 by being mounted on their corresponding TCP 1.

The source drivers S, while being mounted on TCP 1, are serially connected to one another with respect to input/output terminals of various signals such as a start pulse signal SPD and clock signal CK supplied from a controller 4 (described later) which is connected to a print substrate 3.

The TCP 1 mounting the source driver S is connected to the liquid crystal panel 2 and to the print substrate 3 respectively on output and input sides. Thus, the print substrate 3 and liquid crystal panel 2 are electrically connected to each other via the group of source drivers S.

Here, the electrical connection between liquid crystal panel 2 and TCP 1 is made by heat bonding outer lead terminals on the output side of the TCP 1 and the terminals of ITO (Indium Tin Oxide) wiring (not shown) provided on a glass substrate of the liquid crystal panel 2, for example, via an ACF (Anisotropic Conductive Film). The electrical connection between TCP 1 and print substrate 3 is made by ACF or solder, by which outer lead terminals on the input side of TCP 1 and wiring of the print substrate 3 are electrically connected to each other.

With this arrangement, signal transfer through source drivers S and between the group of source drivers S and the controller 4 proceeds through wiring on TCP 1 and wiring on print substrate 3.

The controller 4 is provided on the side of a source driver S(1) or source driver S(n) of the group of source drivers S on the print substrate 3. In the liquid crystal module of FIG. 1, the controller 4 is provided on the side of the source driver S(1) on the first stage, and the signals are first supplied to the source driver S(1).

The controller 4 is for supplying control signals and power to the group of source drivers S, which control signals and power include: start pulse signal SPD which is in synchronism with a horizontal synchronize signal of a video signal; clock signal CK; video signal Video; switch signal RL which decides transfer direction of the start pulse signal SPD through the source drivers S by switching the bidirectional shift register and input/output buffers, etc., in the source drivers S; and power VCC and GND, etc. Note that, though not specifically shown in FIG. 1, the controller 4 also supplies control signals and power to a group of gate drivers in the same manner.

In FIG. 1, the clock signal CK, video signal Video, switch signal RL, and power VCC and GND supplied from the controller 4 are inputted through wiring on the print substrate 3 and on TCP 1 to input terminal CK1, input terminal Video 1, input terminal RL1, power terminal VCC, and power terminal GND of the source driver S(1), respectively, and by transferring through inner wiring of, for example, aluminium wire in the source driver S(1), they are outputted from output terminal CK2, output terminal Video 2, output terminal RL2, power terminal VCC and power terminal GND of the source driver S(1), respectively, to be inputted in the same manner to a source driver S(2) of the next stage. Note that, these signal supply lines may be provided as a common wire by the wiring on the print substrate 3 and individually inputted to each source driver S.

Figure 14:
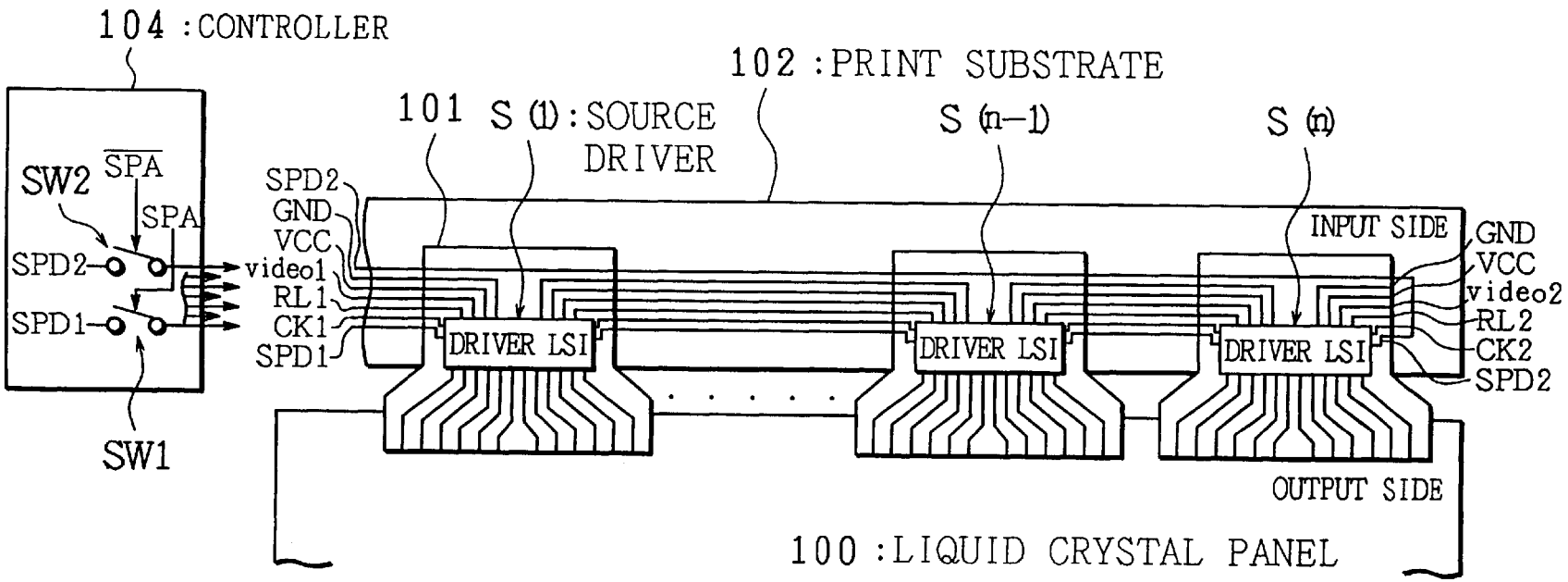
FIG. 14 PRIOR ART
FIG. 14 is a plan view showing a structure of a conventional liquid crystal module.
Figure 15:
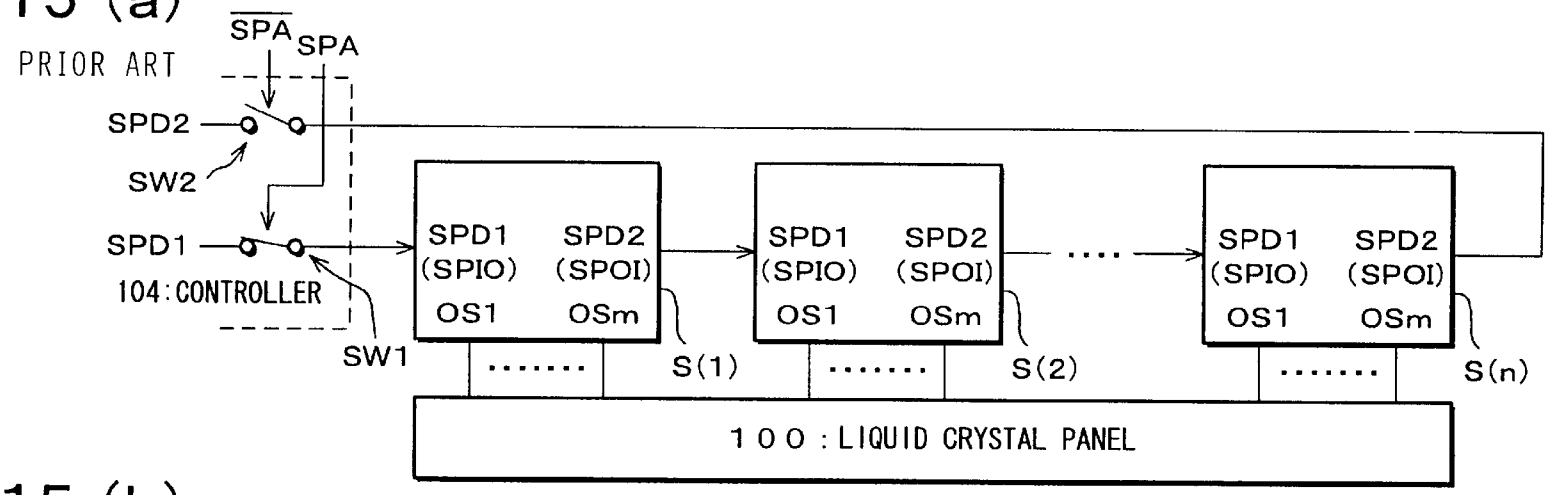
FIG. 15 (a) PRIOR ART
FIG. 15(*a*) is a block diagram showing an example of how a start pulse signal is supplied in the liquid crystal module of FIG. 14.
Figure 15:
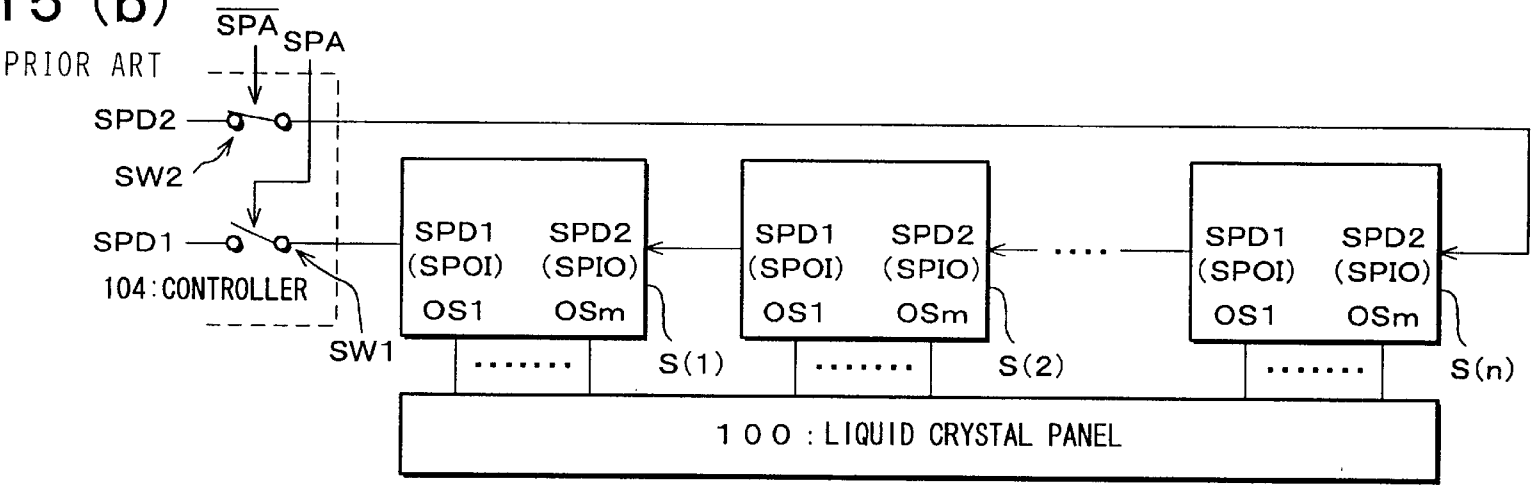
FIG. 15 (b) PRIOR ART

Meanwhile, in inputting of the start pulse signal SPD, the conventional liquid crystal module of FIG. 14 as described above has the arrangement in which there are provided two lines as the supply line of the start pulse signal SPD from the controller 104, one being connected to the input/output terminal SPD1 of the source driver S(1) of the first stage, and the other being connected to the input/output terminal SPD2 of the source driver S(n) of the nth stage, and thus has the problem of, for example, complicating the controller 104 as mentioned above.

In contrast, in the liquid crystal module of FIG. 1, the input/output terminal SPD1 of the source driver S(1) and the input/output terminal SPD2 of the source driver S(n) of the nth stage are connected to each other by wiring on the print substrate 3 (wiring of each TCP 1 may also by used in conjunction with the wiring on print substrate 3), and this single common line is the only supply line of the start pulse signal SPD from the controller 4.

Further, as the line for inputting a set signal for controlling the operation state of output buffer circuits of input/output buffers (to be described later) which are provided on input/output terminal SPD1 and input/output terminal SPD2 of each source driver S, respectively, there are additionally provided, for example, second power terminals VCC1 and GND1 for each source driver S.

The potential level obtained from the second power terminals VCC1 and GND1 is inputted as a set signal to a set terminal of the output buffer circuit of the input/output buffer provided in each source driver S in accordance with a desired transfer direction of the video signal so as to decide the transfer direction of the start pulse signal.

Though described later in detail, the output buffer circuits of the source drivers S except the source driver S on the last stage with respect to the transfer direction are operated in the same manner as the conventional output buffer circuit, and only the buffer circuit of the source driver S of the last stage, which is provided on the output terminal of the start pulse signal SPD is brought to a high impedance state.

Figure 2:
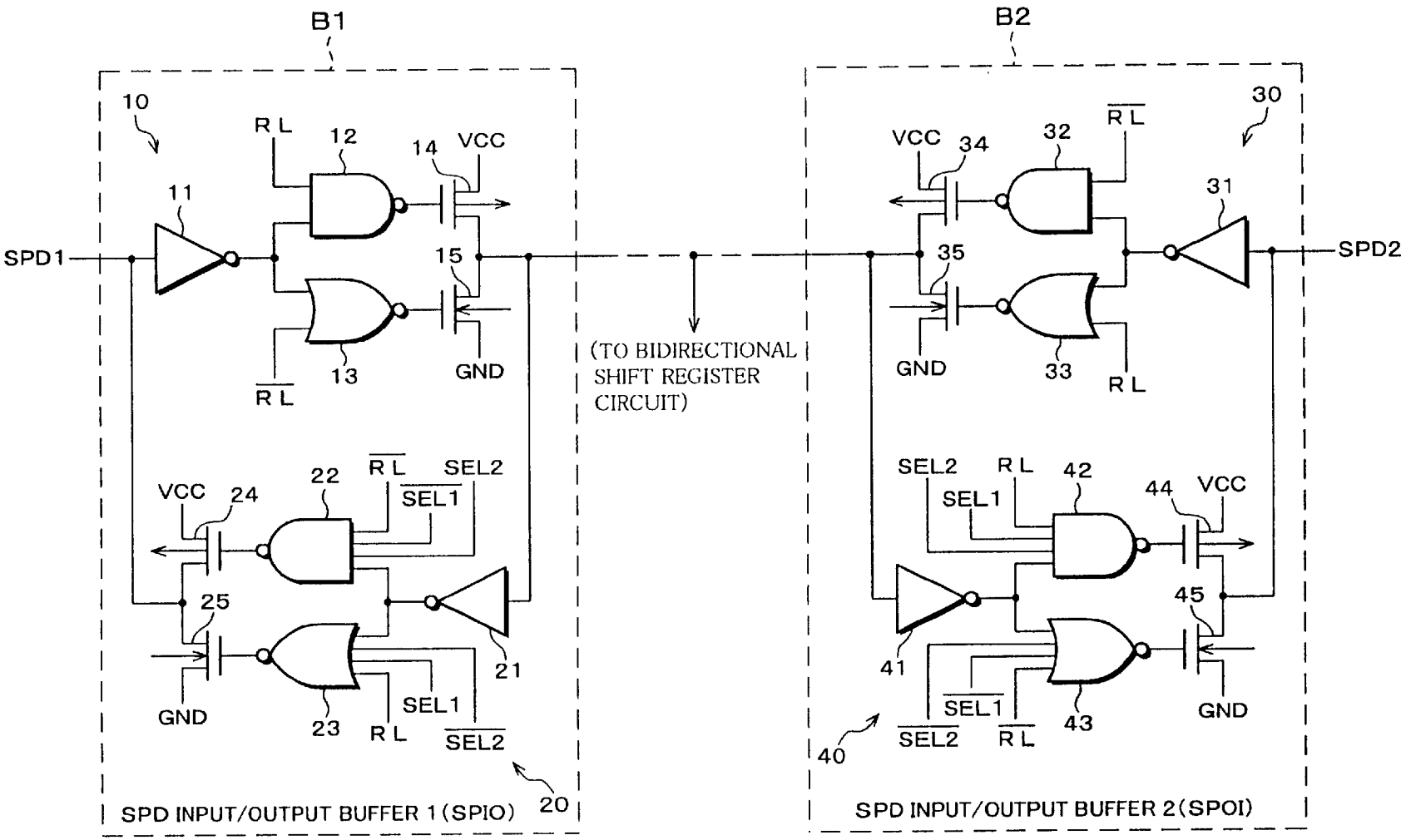
FIG. 2 is a circuit diagram showing a structure of an SPD input/output buffer of each source driver of the liquid crystal module of FIG. 1.

FIG. 2 shows specific circuit structures of SPD input/output buffer B1 and SPD input/output buffer B2, which are respectively provided on the input/output terminal SPD1 and input/output terminal SPD2 of one of the group of source drivers S. Note that, the source drivers S all have the same structure.

The SPD input/output buffer B1 is composed of input buffer circuit 10 and output buffer circuit 20, wherein the former includes inverter 11, NAND gate 12, NOR gate 13, p-channel MOSFET 14, and n-channel MOSFET 15, and the latter includes inverter 21, NAND gate 22, NOR gate 23, p-channel MOSFET 24, and n-channel MOSFET 25.

In the input buffer circuit 10, the input terminal of the inverter 11 is connected to the input/output terminal SPD1, and the output terminal thereof is connected to one of the input terminals of the NAND gate 12 having two input terminals, and to one of the input terminals of the NOR gate 13 having two terminals.

To the other input terminal of the NAND gate 12 is inputted switch signal RL, and to the other input terminal of the NOR gate 13 is inputted switch signal/RL (inverted signal of RL) via an inverter (not shown).

The output terminal of the NAND gate 12 is connected to the gate of the p-channel MOSFET 14, and the output terminal of the NOR gate 13 is connected to the gate of the n-channel MOSFET 15.

The drain of the p-channel MOSFET 14 is connected to power terminal VCC and is maintained at "High" level potential VCC, and the source of the n-channel MOSFET 15 is connected to power terminal GND and is maintained at "Low" level potential GND.

The source of the p-channel MOSFET 14 is connected to the drain of the n-channel MOSFET 15, and the junction thereof is connected to a latch circuit on the first stage of the bidirectional shift register circuit (transfer circuit) (not shown).

In the output buffer circuit 20, the input terminal of the inverter 21 is connected to the latch circuit on the first stage of the bidirectional shift register circuit, and the output terminal thereof is connected to one of four input terminals of the NAND gate 22, and to one of four input terminals of the NOR gate 23.

The remaining three input terminals of the NAND gate 22 receive switch signal/RL, set signal SEL1 (inverted signal of SEL), and set signal SEL2, respectively. The remaining three input terminals of the NOR gate 23 receive switch signal RL, set signal SEL1, and set signal/SEL2 (inverted signal of SEL2), respectively.

The output terminal of the NAND gate 22 is connected to the gate of the p-channel MOSFET 24, and the output terminal of the NOR gate 23 is connected to the gate of the n-channel MOSFET 25.

The drain of the p-channel MOSFET 24 is connected to power terminal VCC and is maintained at "High" level potential VCC, and the source of the n-channel MOSFET 25 is connected to power terminal GND and is maintained at "Low" level potential GND. Further, the source of the p-channel MOSFET 24 is connected to the drain of n-channel MOSFET 25, and the junction thereof is connected to the input/output terminal SPD1.

The SPD input/output buffer B2 is indicated by the circuit on the right side of FIG. 1, and it is composed of input buffer circuit 30 and output buffer circuit 40, wherein the former includes inverter 31, NAND gate 32, NOR gate 33, p-channel MOSFET 34, and n-channel MOSFET 35, and the latter includes inverter 41, NAND gate 42, NOR gate 43, p-channel MOSFET 44, and n-channel MOSFET 45.

In the input buffer circuit 30, the input terminal of the inverter 31 is connected to the input/output terminal SPD2, and the output thereof is connected to one of the input terminals of the NAND gate 32 and to one of the input terminals of the NOR gate 33. To the other input terminal of the NAND gate 32 is inputted switch signal/RL via an inverter (not shown), and to the other input terminal of the NOR gate 33 is inputted switch signal RL.

The output terminal of the NAND gate 32 is connected to the gate of the p-channel MOSFET 34, and the output terminal of the NOR gate 33 is connected to the gate of the n-channel MOSFET 35.

The drain of the p-channel MOSFET 34 is connected to power terminal VCC and is maintained at "High" level potential VCC, and the source of the n-channel MOSFET 35 is connected to power terminal GND and is maintained at "Low" level potential GND. Further, the source of the p-channel MOSFET 34 is connected to the drain of the n-channel MOSFET 35, and the junction thereof is connected to the latch circuit on the last stage of the bidirectional shift register circuit.

In the output buffer circuit 40, the input terminal of the inverter 41 is connected to the latch circuit on the last stage of the bidirectional shift register circuit, and the output terminal thereof is connected to one of four input terminals of the NAND gate 42, and to one of four input terminals of the NOR gate 43.

The remaining three input terminals of the NAND gate 42 receive switch signal RL, set signal SEL1, and set signal SEL2, respectively. The remaining three input terminals of the NOR gate 43 receive switch signal/RL, set signal/SEL1, and set. signal/SEL2, respectively.

The output terminal of the NAND gate 42 is connected to the gate of the p-channel MOSFET 44, and the output terminal of the NOR gate 43 is connected to the gate of the n-channel MOSFET 45.

The drain of the p-channel MOSFET 44 is connected to power terminal VCC and is maintained at "High" level potential VCC, and the source of the n-channel MOSFET 45 is connected to power terminal GND and is maintained at "Low" level potential GND. Further, the source of the p-channel MOSFET 44 is connected to the drain of the n-channel MOSFET 45, and the junction thereof is connected to the input/output terminal SPD2.

In the described structure of the SPD input/output buffer BE, under the condition where the switch signal RL is at "High" level, when the input/output terminal SPD1 becomes "High" level, the n-channel MOSFET 15 of the input buffer circuit 10 will be in an ON state, and the p-channel MOSFET 14 will be in a high impedance state. On the other hand, when the input/output terminal SPD1 becomes "Low" level, the n-channel MOSFET 15 will be in a high impedance state and the p-channel MOSFET 14 will be in an ON state.

Here, in the output buffer circuit 20, because the switch signal RL is "High" level, the p-channel MOSFET 24 and n-channel MOSFET 25 are both turned OFF regardless of the output of the inverter 21 and the levels of set signals SEL1 and SEL2, and as a result the p-channel MOSFET 24 and n-channel MOSFET 25 both will be in a high impedance state. Thus, the SPD input/output buffer B1 operates solely as input buffer circuit 10, thereby operating as an input buffer.

In the SPD input/output buffer B2, the p-channel MOSFET 34 and n-channel MOSFET 35 of the input buffer circuit 30 both will be in a high impedance state when switch signal RL is at "High" level, regardless of the signal level which enters the input terminal of the inverter 31.

Here, in the output buffer circuit 40, when the input/output terminal SPD1 becomes "High" level, a "Low" level is inputted to the input terminal of the inverter 41 via the bidirectional shift register circuit. Here, by the set signals SEL1 and SEL2 which enter the NAND gate 42 and NOR gate 43, either one of the p-channel MOSFET 44 and n-channel MOSFET 45 will be in an ON state and the other will be in an OFF state, or the p-channel MOSFET 44 and n-channel MOSFET 45 both will be in an OFF state and thus high impedance state. Therefore, by setting the set signals SEL1 and SEL2 so as to make only one of the p-channel MOSFET 44 and n-channel MOSFET 45 turned ON by a SPD1 signal, the SPD input/output buffer B2 operates as an output buffer.

When the switch signal RL is "Low" level, the reverse situation occurs and the SPD input/output buffer B1 operates as an output buffer, and the SPD input/output buffer B2 operates as an input buffer.

Table 1 shows operations of the switch signal RL and set signals SEL1 and SEL2 with respect to their logic levels in the SPD input/output buffers BE and B2 having the described structures.

TABLE 1

| | RL | SEL1 | SEL2 | SPD1 | SPD2 |
|---|---|---|---|---|---|
| ① | H | H | H | INPUT | OUTPUT |
| ② | H | L | H | INPUT | HIGH IMPEDANCE |
| ③ | L | H | H | HIGH IMPEDANCE | INPUT |
| ④ | L | L | H | OUTPUT | INPUT |
| ⑤ | H | *1 | L | INPUT | HIGH IMPEDANCE |
| ⑥ | L | *1 | L | HIGH IMPEDANCE | INPUT |

*1 SEL1 can either be "H" or "L"

As can be seen from Table 1, when the transfer direction of the start pulse signal SPD is from the source driver S(1) to the source driver S(n), the logic levels of switch signal RL, set signal SEL1, and set signal SEL2 of the output buffer circuit 40 of the SPD input/output buffer B2 are set to be the combination of logic levels as in ① of Table 1 from the source driver S(1) of the first stage to the source driver S(n) of the last stage (n), in which the input/output terminal SPD1 and input/output terminal SPD2 are in "INPUT" and "OUTPUT" states, respectively, and in the source driver S(n) of the last stage, the logic levels of switch signal RL, set signal SEL1, and set signal SEL2 of the output buffer circuit 40 of the SPD input/output buffer B2 are set to be the combination of logic levels as in ② or ⑤ of Table 1, in which the input/output terminal SPD1 and input/output terminal SPD2 are in "INPUT" and "HIGH IMPEDANCE" states, respectively.

Specifically, by setting the switch signal RL from the controller 4 at "High" level, from the source driver S(n) of the first stage to the source driver S(n−1), the set signals SEL1 and SEL2 in the output buffer circuit 40 of the SPD input/output buffer B2 are set at "High" level by connecting the input terminals SEL1 and SEL2 to the second power terminal VCC1 drawn from the VCC line. Only in the nth source driver S(n) of the last stage, input terminal SEL1 is connected to the second power terminal GND1 drawn from the GND line so as to make the set signal SEL1 at "Low" level, and input terminal SEL2 is connected to the second power terminal VCC1 so as to make the set signal SEL2 at "High" level, or, alternatively, input terminal SEL1 is connected to the second power terminal GND1 or second power terminal VCC1 so as to make the set signal SEL1 at "Low" level or "High" level, and the input terminal SEL2 is connected to the second power terminal GND2 so as to make the set signal SEL2 at "Low" level.

On the other hand, when the transfer direction of the start pulse signal SPD is from the source driver S(n) to the source driver S(1), the logic levels of switch signal RL, set signal SEL1, and set signal SEL2 are set to be the combination of logic levels as in ④ of Table 1 from the nth source driver S(n) to the source driver S(2), in which the input/output terminal SPD2 and input/output terminal SPD1 are in "INPUT" and "OUTPUT" states, respectively, and in the first source driver S(1), the logic levels of switch signal RL, set signal SEL1, and set signal SEL2 are set to be the combination of logic levels as in ③ or ⑥ of Table 1, in which the input/output terminal SPD2 and input/output terminal SPD1 are in "INPUT" and "HIGH IMPEDANCE" states, respectively.

Specifically, the switch signal RL from the controller 4 is set at "Low" level, and from the nth source driver S(n) to the source driver S(2), the set signal SEL1 in the buffer circuit 20 of the SPD input/output buffer B1 is set at "Low" level by connecting the input terminal SEL1 to the second power terminal GND1, and is set at "High" level by connecting the input terminal SEL2 to the second power terminal VCC1. Only in the first source driver S(1) of the last stage, the input terminals SEL1 and SEL2 are both connected to the second power terminal VCC1 so as to make set signals SEL1 and SEL2 at "High" level, or input terminal SEL1 is connected to the second power terminal GND1 or second power terminal VCC1 so as to make set signal SEL1 at "Low" level or "High" level, and input terminal SEL2 is connected to the second power terminal GND2 so as to make set signal SEL2 at "low" level.

Figure 3:
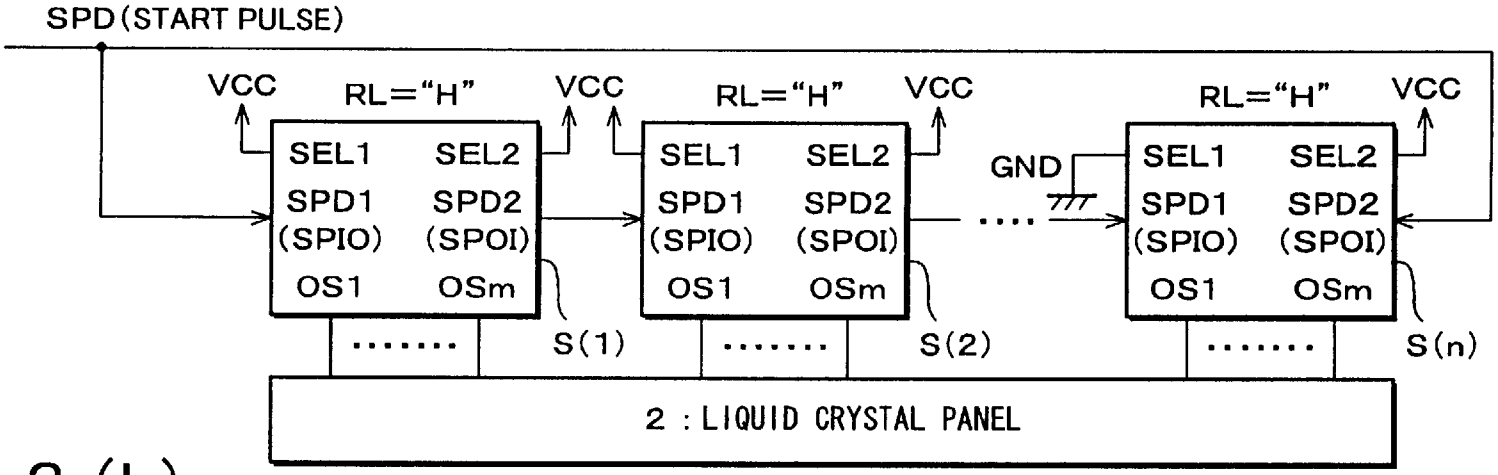
FIG. 3(*a*) is a block diagram showing an example of how a start pulse signal is supplied in the liquid crystal module of FIG. 1.
Figure 3:
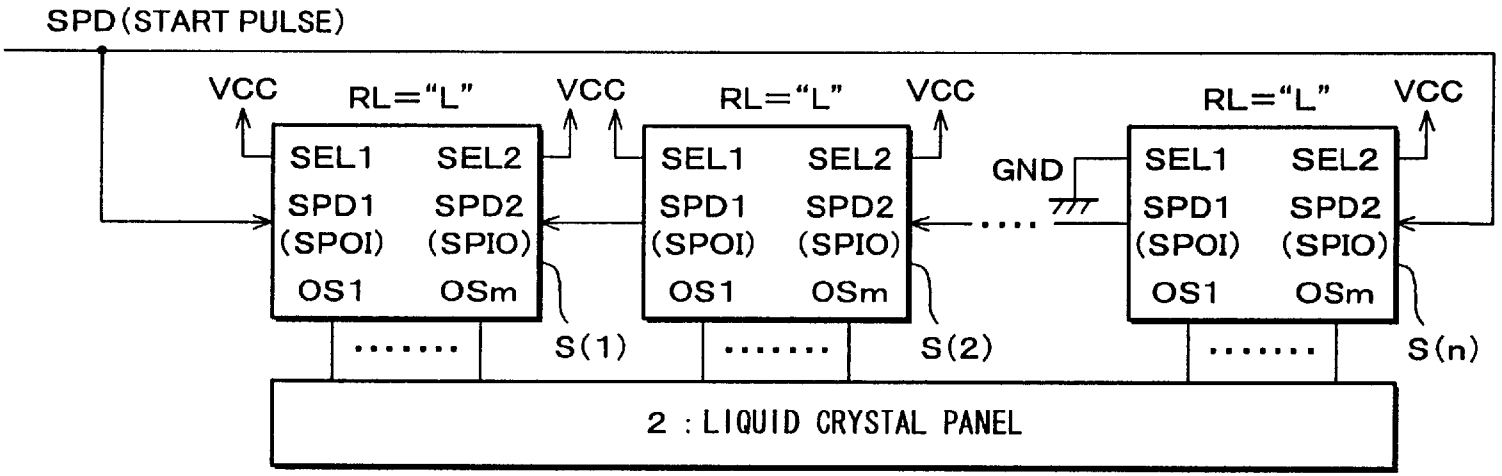

FIGS. 3(*a*) and 3(*b*) show an example of how switch signal RL and set signals SET1 and SET2 are supplied with respect to the transfer direction of the start pulse signal SPD in the display driving device having the plurality of source drivers S which adopts the structure of the liquid crystal module as shown in FIG. 1. In FIGS. 3(*a*) and 3(*b*), OS1 to OSm are output terminals of each source driver S to the liquid crystal panel 2 (this is also the same in FIGS. 4(*a*) and 4(*b*), FIGS. 6(*a*) and 6(*b*), and FIGS. 7(*a*) and 7(*b*)).

In FIG. 3(*a*), start pulse signal SPD is inputted into the source driver S(1) from the input/output terminal SPD1 and is transferred from the source driver S(1) to the source driver S(n). In FIG. 3(*b*), start pulse signal SPD is inputted into the nth source driver S(n) from the input/output terminal SPD2 and is transferred from the source driver S(n) to the source driver S(1).

Figure 4:
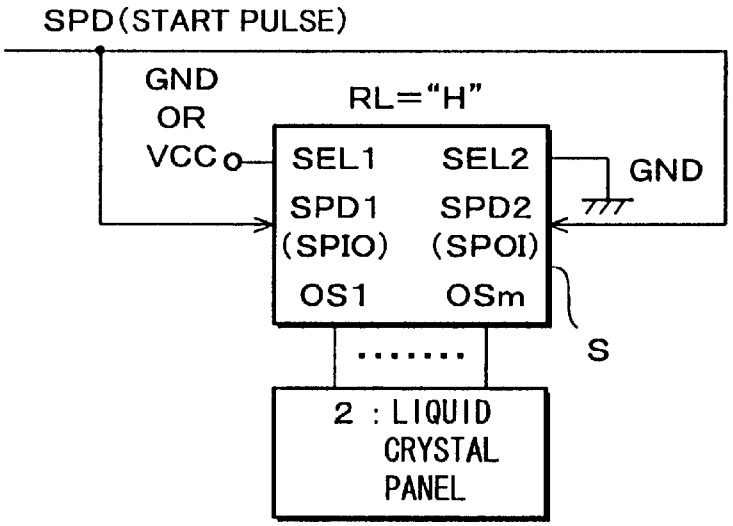
FIG. 4(*a*) is a block diagram showing how a start pulse signal is supplied in a liquid crystal module employing a single source driver, showing another embodiment of the present invention.
Figure 4:
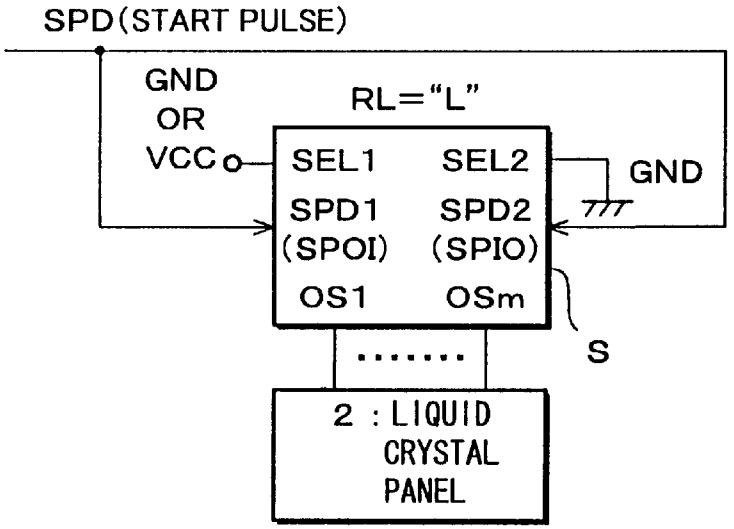

FIGS. 4(*a*) and 4(*b*) show an example of how switch signal RL and set signals SEL1 and SEL2 are supplied with respect to the transfer direction of the start pulse signal in a display driving device adopting a single source driver S. In FIG. 4(*a*), the start pulse signal SPD is inputted into the source driver S from the input/output terminal SPD1 and is transferred therein. In FIG. 4(*b*), start pulse signal SPD is inputted into the source driver S from input/output terminal SPD2 and transferred therein.

Figure 5:
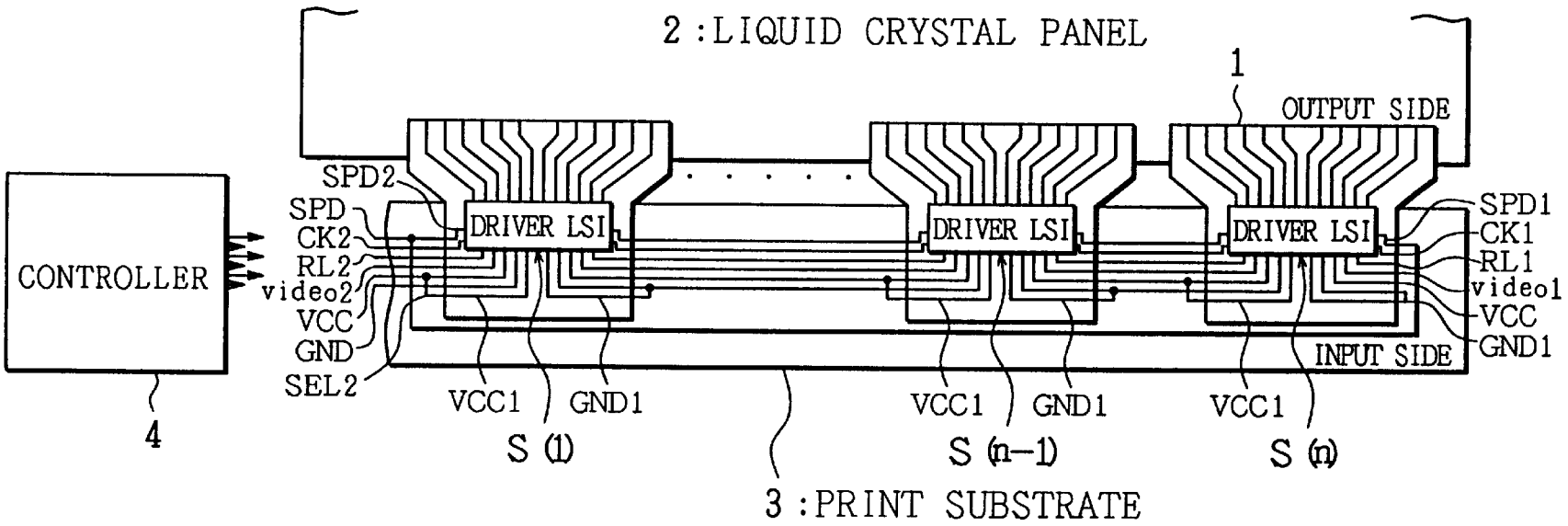
FIG. 5 is a plan view showing a structure of a liquid crystal module employing plural source drivers, showing another embodiment of the present invention.
Figure 6:
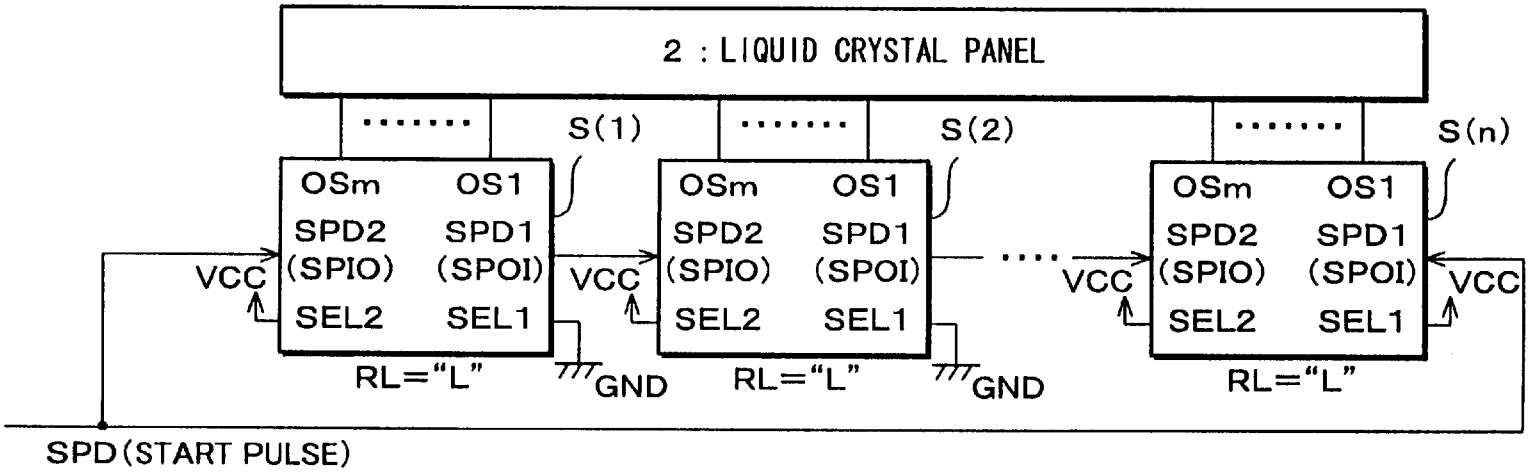
FIG. 6(*a*) is a block diagram showing an example of how a start pulse signal is supplied in the group of source drivers of the liquid crystal module of FIG. 5.
Figure 6:
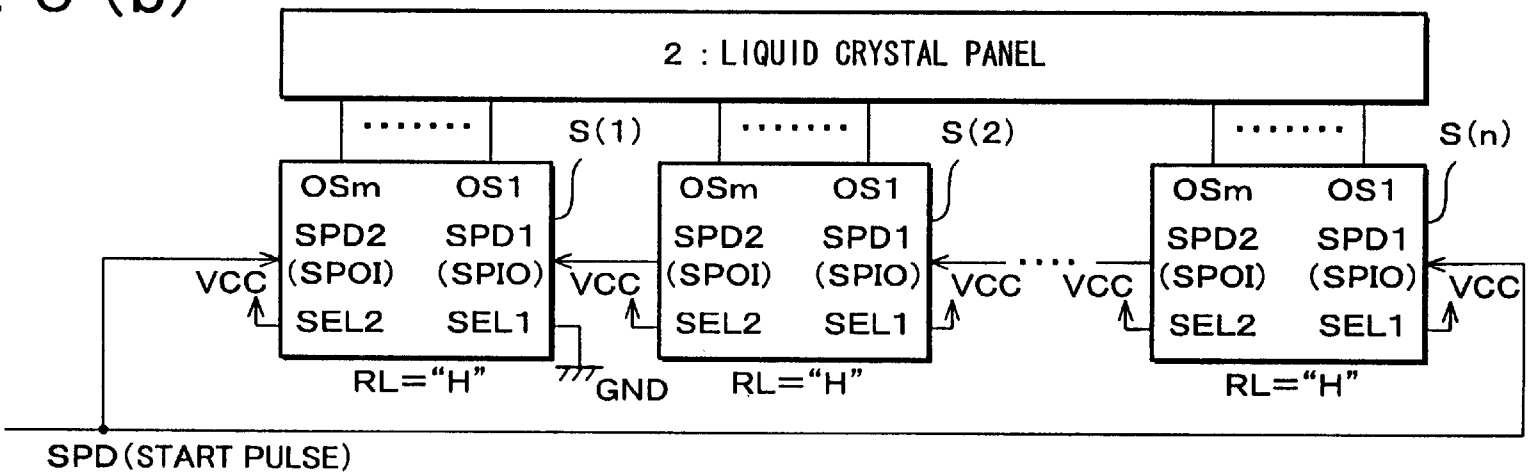
Figure 16:
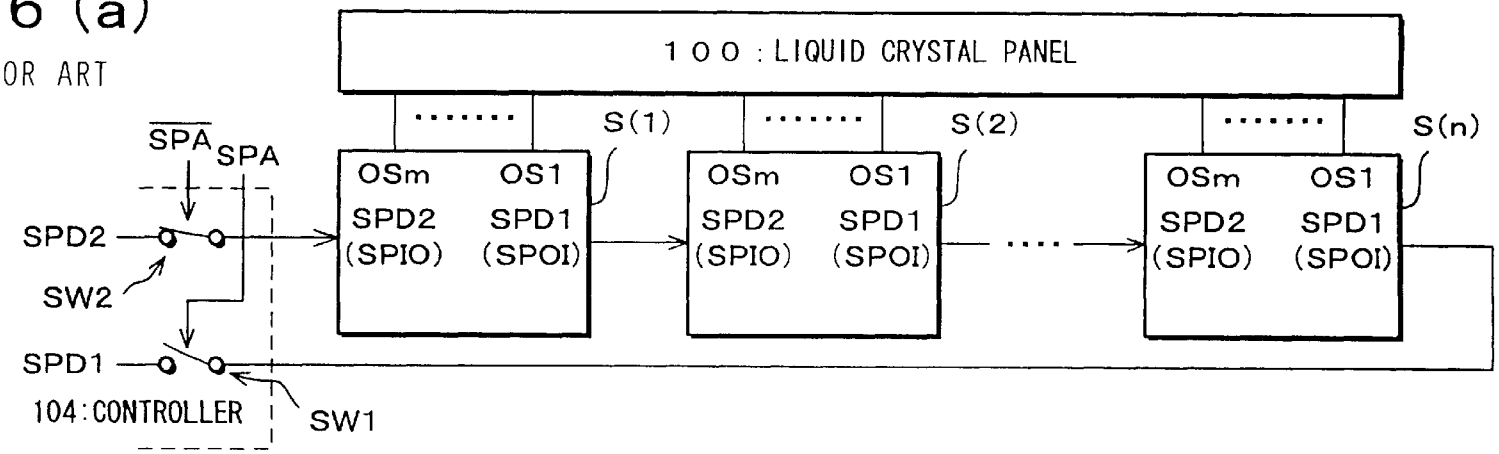
FIG. 16 (a) PRIOR ART
FIG. 16(*a*) is a block diagram showing how a start pulse signal is supplied in the liquid crystal module of FIG. 17.
Figure 16:
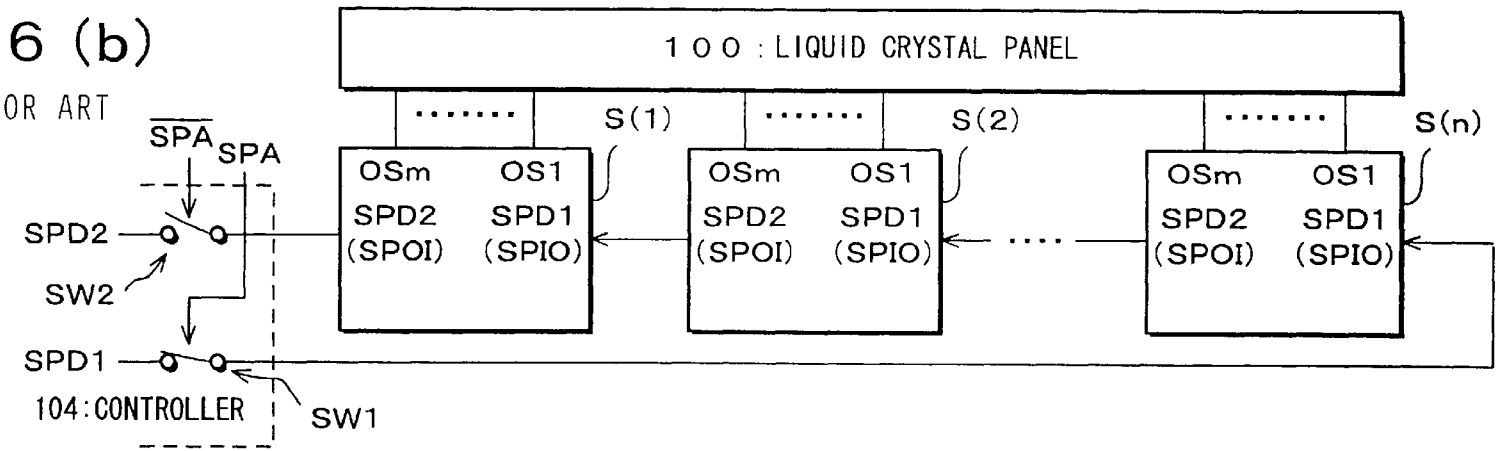
FIG. 16 (b) PRIOR ART
Figure 17:
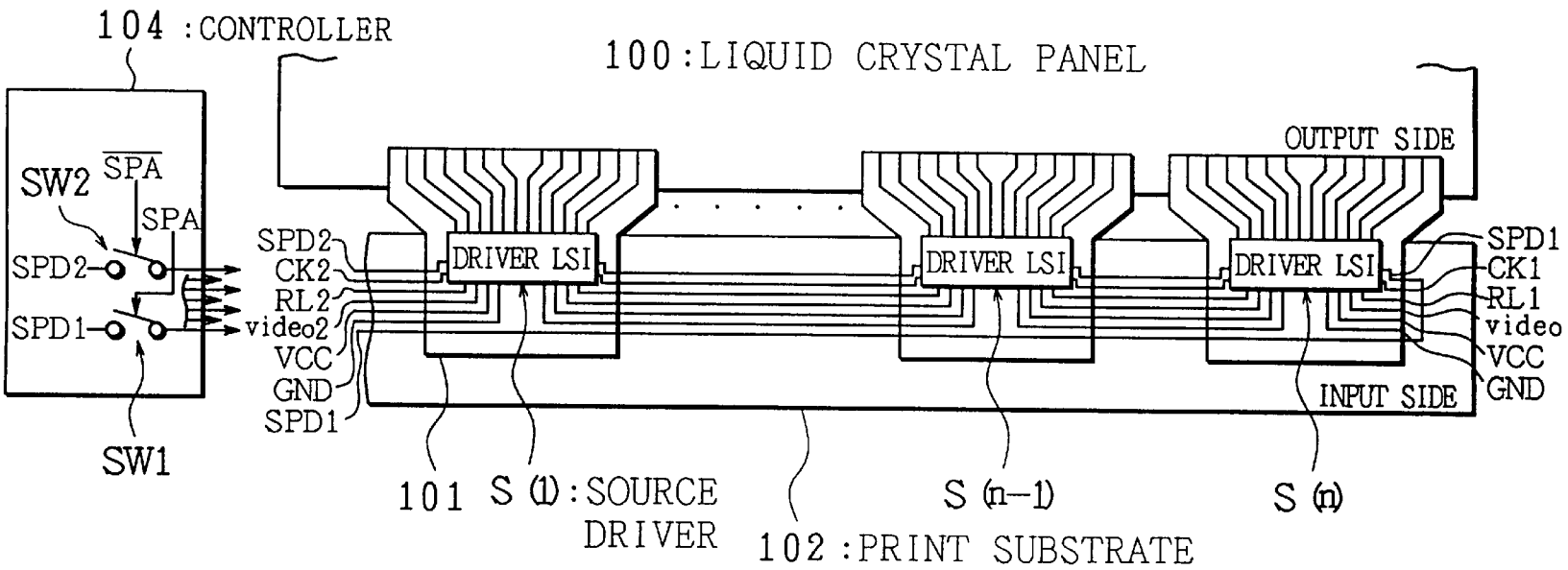
FIG. 17 PRIOR ART
FIG. 17 is a plan view showing another structure of the conventional liquid crystal module.

Further, FIG. 5, corresponding to FIG. 17, shows a structure of a liquid crystal module of another embodiment of the present invention, which is the liquid crystal module of FIG. 17 adopting the source drivers S on the lower side of the liquid crystal panel 1, and FIGS. 6(*a*) and 6(*b*), corresponding to FIGS. 16(*a*) and 16(*b*), respectively, show an example of how switch signal RL and set signals SEL1 and SEL2 are supplied with respect to the transfer direction of the start pulse signal in the display driving device of the liquid crystal module having the plurality of source drivers S.

In FIG. 6(*a*), start pulse signal SPD is inputted into the source driver S(1) from the input/output terminal SPD2 and is transferred from the source driver S(1) to the source driver S(n). In FIG. 6(*b*), start pulse signal SPD is inputted into the source driver S(n) from the input/output terminal SPD1 and is transferred from the source driver S(n) to the source driver S(1).

Figure 7:
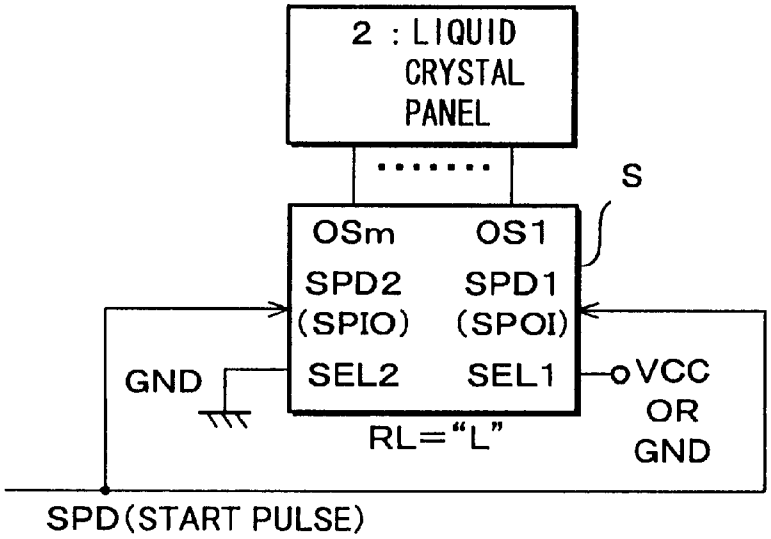
FIG. 7(*a*) is a block diagram showing an example of how a start pulse signal is supplied in a liquid crystal module employing a single source driver, showing another embodiment of the present invention.
Figure 7:
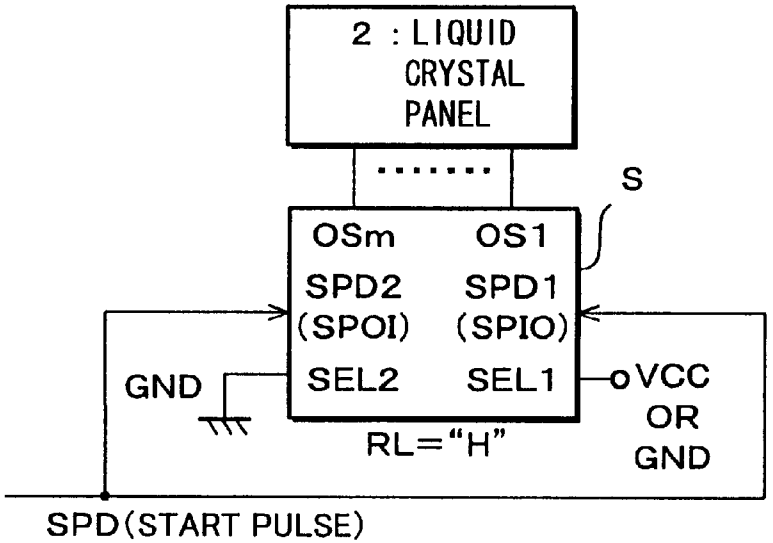

FIGS. 7(*a*) and 7(*b*) show an example how switch signal RL and set signals SEL1 and SEL2 are supplied with respect to the transfer direction of the start pulse signal SPD in the display driving device adopting a single source driver S on the lower side of the liquid crystal panel 1.

Note that, in FIG. 1 and FIG. 5, the connection lines on the sides of SPD2 and SPD1 are directly connected to the terminals of the controller 4 via wiring on the TCP 1 and wiring on the print substrate 3. However, signals may be transferred via connection lines through source drivers S using the inner wiring of each source driver S.

Also, without providing the print substrate 3, transfer of signals through source drivers S and between the group of source drivers and controller 4 may be carried out via wiring on the TCP 1 and wiring (e.g., ITO wiring) on the glass substrate of the liquid crystal panel 2.

Further, transfer of signals may be carried out via wiring (e.g., ITO wiring) on the glass substrate of the liquid crystal panel 2 by mounting LSI (may include LSI of the controller 4) making up each source driver S as a chip-on-glass (COG).

In this manner, by adopting the described arrangement in accordance with the present invention, it is possible to provide a display driving device which can switch the transfer direction of the start pulse signal SPD without a switching operation of closing and opening the switch by the provision of the means such as analog switches on the side of the controller 4, thus reducing the number of circuits on the side of the controller and the number of terminals of the semiconductor device provided on the side of the controller from that of the conventional arrangement, thereby further reducing the size and cost of the liquid crystal module.

Further, because only a single line is required between the controller 4 and the group of source drivers S, compared with the conventional arrangement where two wires are provided, the size of the liquid crystal module can be reduced, and the adverse effect of a noise can be reduced by widening the pitch of the wiring pattern which could otherwise have been narrowed by the reduced size of the liquid crystal module. Further, because only a single wire is required from the controller 4, it is not required to change the wiring pattern even when the positional relationship between the controller and the group of source drivers S is changed, thus making designing of the liquid crystal module easier.

Further, in the described liquid crystal module of the present embodiment, respective output buffer circuits 40 and 20 of the SPD input/output buffers B2 and B1 are arranged so as to prevent output of the start pulse signal SPD from the output terminal (SPD1–SPD2) by setting the output terminal (SPD1–SPD2) at a "HIGH IMPEDANCE" state, and the operating states of the output buffers 40 and 20 are managed by using a power. voltage as a set signal of the logic gates of the output buffer circuits 40 and 20 in the source driver S.

As a result, "HIGH IMPEDANCE" state can easily be brought about only by providing circuits which are compatible with set signals SEL1 and SEL2 in the conventional input/output buffers. The increase in number of circuit elements by providing these additional circuits is small, and this arrangement can easily be realized, nor does it cause the chip area to increase. Further, because this arrangement can be realized only by changing the pattern of TCP 1, it requires only one type of driving semiconductor element, permitting the arrangement to be realized at low cost. Further, in this arrangement, switching can be made easily only by inputting power levels (VCC, GND), by which the arrangement can be made simpler and can be realized easily by the internal circuits without requiring external circuits, thus having an advantage in reducing manufacturing cost.

Second Embodiment

Figure 8:
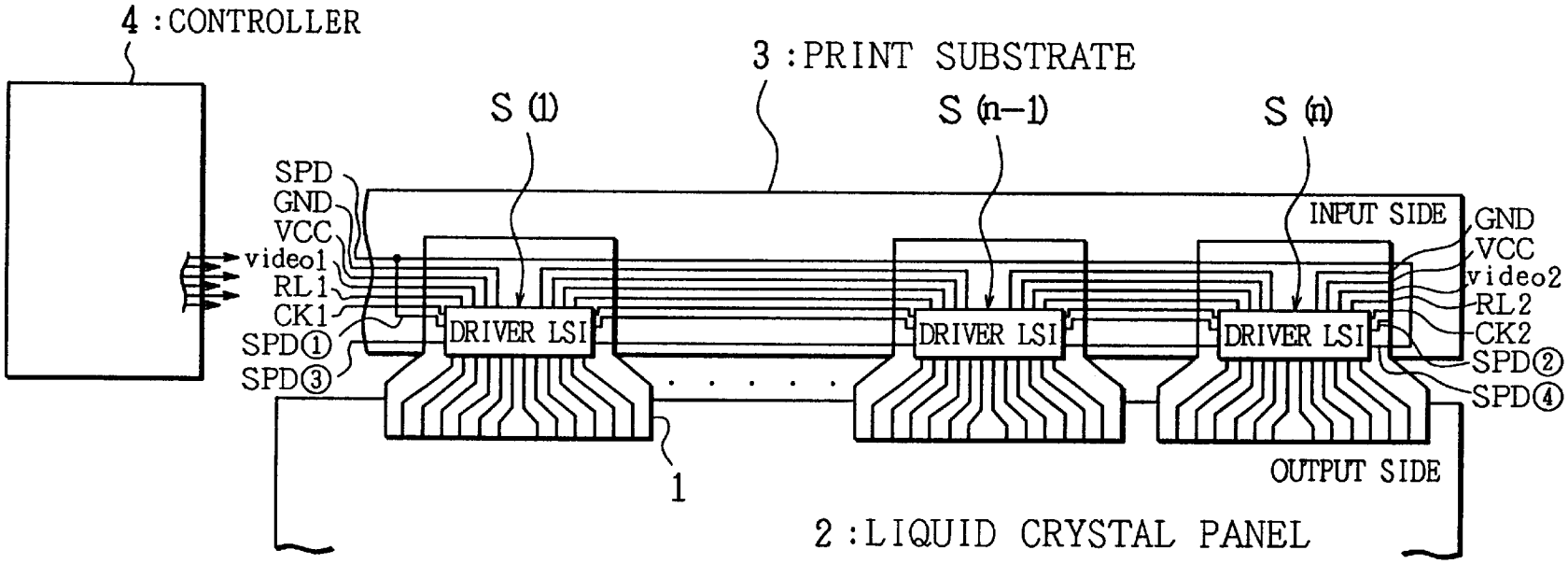
FIG. 8 is a plan view showing a structure of a liquid crystal module employing plural source drivers, showing yet another embodiment of the present invention.

The following will describe another embodiment of the present invention referring to FIG. 8 through FIG. 13. Note that, for convenience of explanation, the elements having the same reference numerals as those described with reference to the drawings in the First Embodiment will be given the same reference numerals and explanations thereof are omitted here. Also, as with the First Embodiment, even though the following description is based on the case where a group of source drivers S are adopted as an example of the display driving device, evidently, the features of the display driving device and the features of the liquid crystal module employing such a display driving device are also applicable to a group of gate drivers. FIG. 8 shows a system arrangement of the display driving device in a liquid crystal module of the present embodiment. The system structure as shown in FIG. 8 is the same as the system structure as described in the First Embodiment (see FIG. 1) in that a single start pulse signal SPD outputted from the controller 4 is branched into two systems to be supplied to the terminals of the source driver S(1) and source driver S(n) for their respective start pulse signals SPD at the both ends of the group of source drivers S which are serially connected to each other. The present embodiment differs from the First Embodiment at the terminal portion of each source driver S for the start pulse signal SPD.

In the First Embodiment, each of the source drivers S constituting the group of source drivers S is provided with input/output terminals SPD1 and SPD2 as the terminals of the start pulse signal SPD, and the two systems of the start pulse signals SPD which were branched from a single start pulse signal SPD are supplied to the input/output terminals SPD1 and SPD2 of the source drivers S at the both ends of the group of source drivers S, respectively.

Further, in the First Embodiment, switching (close or open) of the two system of the start pulse signals SPD which were branched from a single start pulse signal SPD is made by controlling the operations of the SPD input/output buffers B1 and B2 respectively provided with the input/output terminals SPD1 and SPD2, so that one of the input/output terminals SPD1 and SPD2 functions as the input terminal and the other functions as the output terminal in accordance with the transfer direction of the data signal. To carry out this operation control, the First Embodiment adopts two types of set signals SEL1 and SEL2, which are provided in addition to the switch signal RL for switching the transfer direction of the bidirectional shift register circuit.

In contrast, in the present embodiment, each of the source drivers S constituting the group of source drivers is provided with two pairs of input terminal and output terminal as the terminals of the start pulse signal SPD on the both sides of the transfer direction. Namely, each source driver is provided with two systems of input terminal and output terminal of the start pulse signal SPD, and the two systems of start pulse signals which were branched from a single start pulse signal are supplied to the input terminals SPD① and SPD④ of the source driver S(1) and source driver S(n), respectively, which are provided at the both ends of the group of source drivers S.

With this arrangement, because it is not required to provide the input/output buffer, the set signals SEL1 and SEL2 for controlling the operation of the input/output buffer are not required, and thus it is not required to provide patterns for the set signals SEL1 and SEL2 on the TCP 1 mounting the source driver S, thus simplifying the arrangement and making designing of TCP 1 easier.

The following describes the system structure of the display driving device in the liquid crystal module of the present embodiment in more detail.

As with the system structure of FIG. 1, in the system structure of FIG. 8, the group of source drivers S are serially connected to each other, and the clock signal CK, video signal Video, switch signal RL, and power Vcc and GND, etc., supplied from the controller 4 are inputted through wiring on the print substrate 3 and on TCP 1 into input terminal CK1, input terminal Video 1, input terminal RL1, power terminal VCC, and power terminal GND of the source driver S(1), respectively, and by transferring through inner wiring of, for example, aluminium wire in the source driver S(1), they are outputted from output terminal CK2, output terminal Video 2, output terminal RL2, power terminal Vcc and power terminal GND of the source driver S(1), respectively, to be inputted in the same manner into the source driver S(2) of the next stage. Note that, as with the First Embodiment, these signal supply lines may be provided as a common wire of the wiring on the print substrate 3 and individually inputted to each source driver S.

The start pulse signal SPD supplied from the controller 4 is branched into two systems and the start pulse signals SPD thus branched are inputted via wiring on the print substrate 3 and on TCP 1 into input terminal ① and input terminal ④ of the first source driver S(1) and nth source driver S(n), respectively, which are provided at the both ends of the group of serially connected source drivers S.

Figure 9:
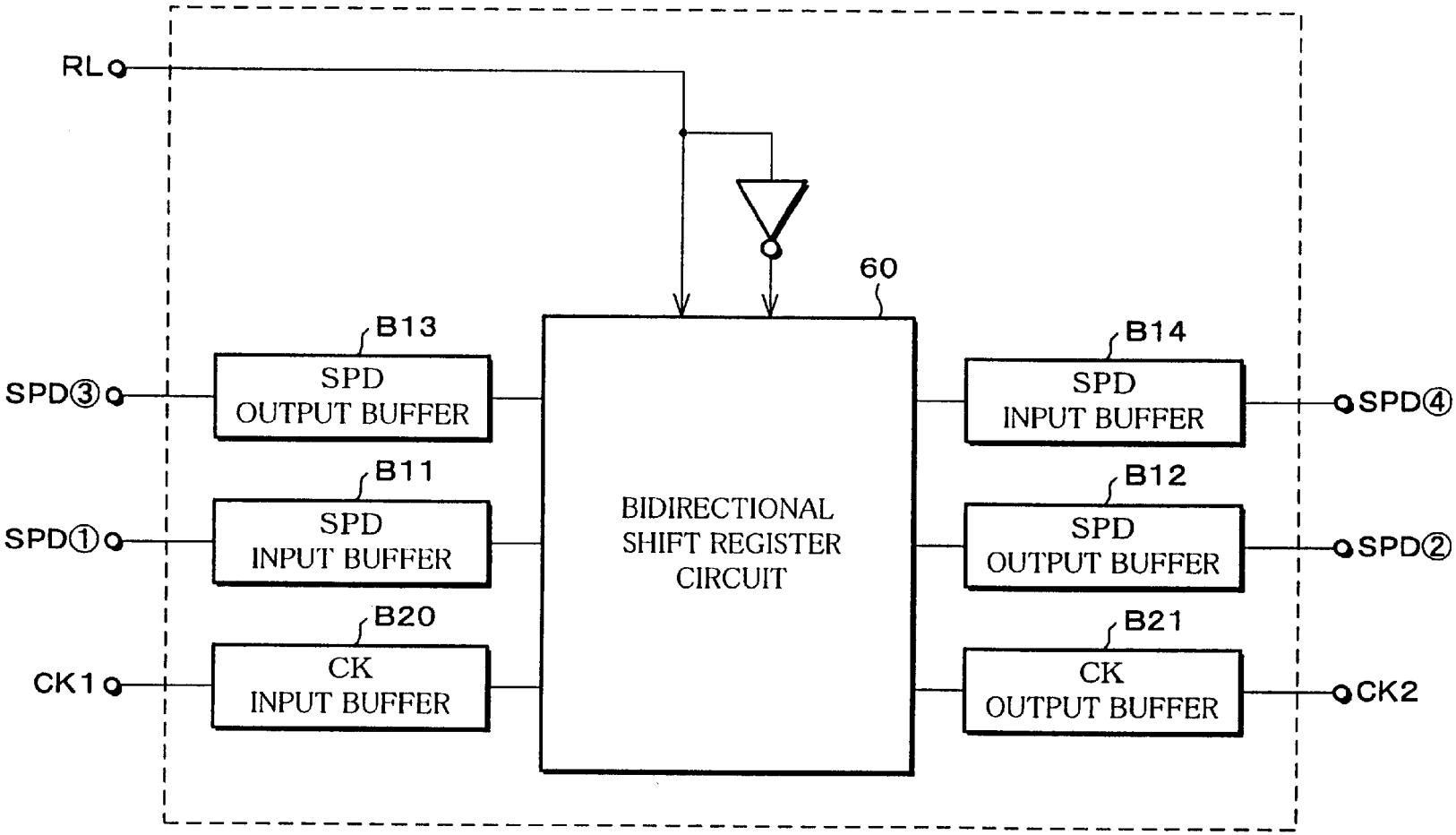
FIG. 9 is a circuit block diagram showing a circuit. structure around a bidirectional shift register of each of the source drivers of FIG. 8.

FIG. 9 is a circuit diagram which relates to the terminals ① to ④ of the four start pulse signals SPD in one of the group of source drivers S. Note that, the source drivers S of the group of source drivers S all have the same structure.

As can be seen from FIG. 9, the bidirectional shift register 60 includes a first system in which the direction of transfer is from the input terminal ① to the output terminal ②, and a second system in which the direction of transfer is from the input terminal ④ to the output terminal ③.

The input terminals SPD① and SPD④ are respectively provided with SPD input buffers B11 and B14, and output terminals SPD② and SPD③ are respectively provided with output buffers B12 and B13. The clock signal CK is inputted via CK input buffer B20 provided on the input terminal CK, and is outputted via CK output buffer B21 provided on the output terminal CK2. The switch signal RL is inputted into the bidirectional shift register 60 either directly or by being inverted by the inverter.

In this source driver S, the start pulse signal SPD inputted from the input terminal SPD① enters the bidirectional shift register 60 via input buffer B11, and by being transferred therein from left to right, it is outputted from the output terminal SPD② via SPD output buffer B12 (First System).

The start pulse signal SPD inputted from the input terminal SPD④ enters the bidirectional shift register 60 via input buffer B14, and by being transferred therein from right to left, it is outputted from the output terminal SPD③ via SPD output buffer B13 (Second System).

In the structure of FIG. 8, n source drivers S, each having the structure as shown in FIG. 9 are serially connected to one another. That is, the output terminal SPD② of the first source driver S(1) and the input terminal SPD① of the second source driver S(2) are connected to each other, and the output terminal SPD③ of the second source driver S(2) and the input terminal SPD④ of the first source driver S(1) are connected to each other. The same connection is made up to the nth source driver S(n).

The start pulse signal SPD is supplied to the input terminal SPD① of the first source driver S(1) and to the input terminal SPD④ of the nth source driver S(n) at the both ends of the group of source drivers S.

As to which of the two systems of the start pulse signals SPD inputted into the group of serially connected source drivers is selected is determined by the conduction or non-conduction of the signals as decided by the switch signal RL which switches the transfer direction of the bidirectional shift register.

Figure 10:
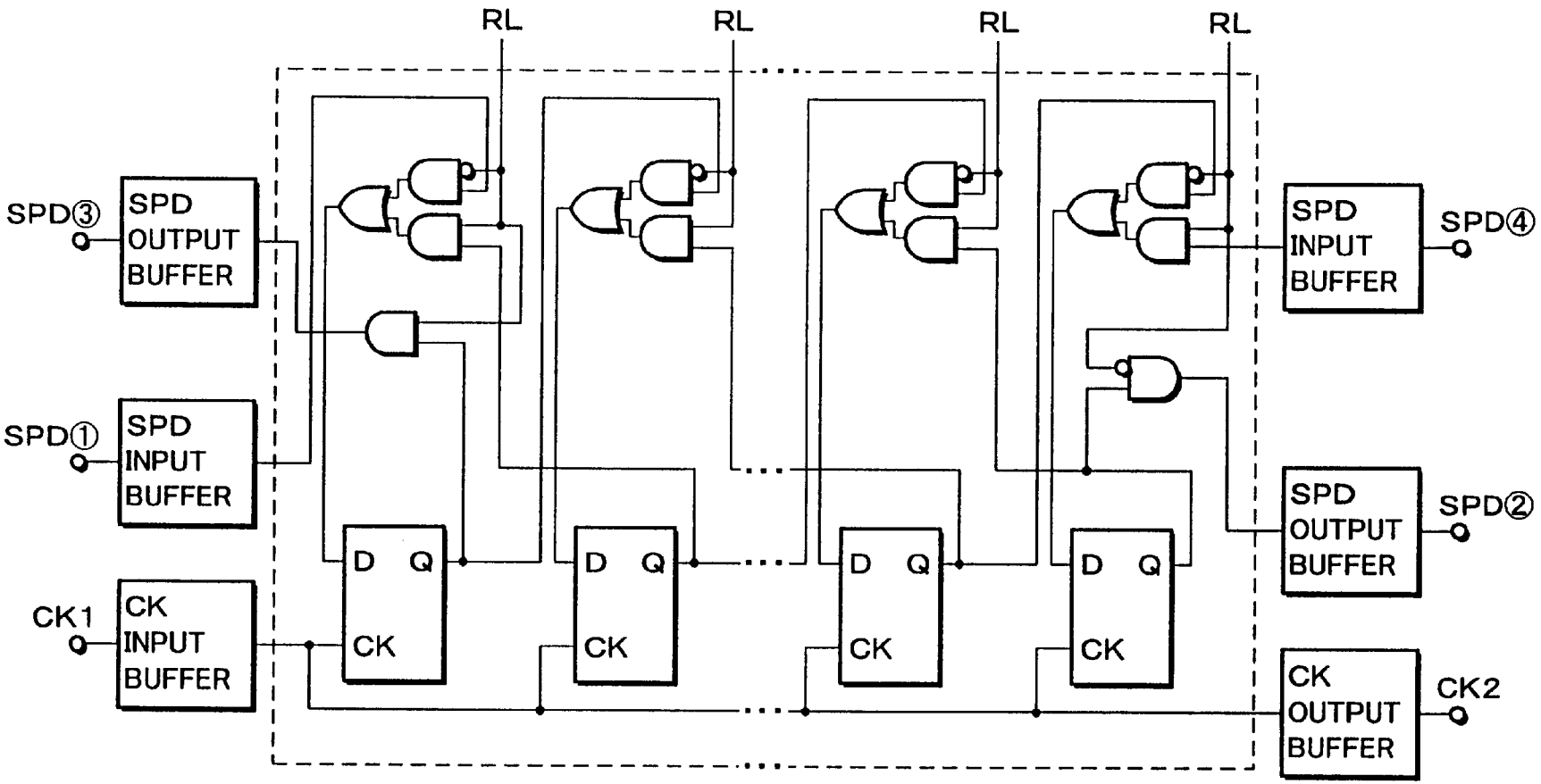
FIG. 10 is a circuit block diagram showing a detailed circuit structure of the bidirectional shift register of FIG. 9.

FIG. 10 shows a detailed circuit diagram of the bidirectional shift register 60 having the two systems of the start pulse signals. The circuit structure of the bidirectional shift register as indicated herein is well known and detailed explanation thereof is omitted here.

In this bidirectional shift register 60, when the switch signal RL is at "High" level, the signal inputted from the input terminal SPD④ is transferred in synchronism with a rise of the clock signal CK and is outputted from the output terminal SPD③. On the other hand, when the switch signal RL is at "Low" level, the signal inputted from the input terminal SPD① is transferred in synchronism with a rise of the clock signal CK and is outputted from the output terminal SPD②.

Figure 11:
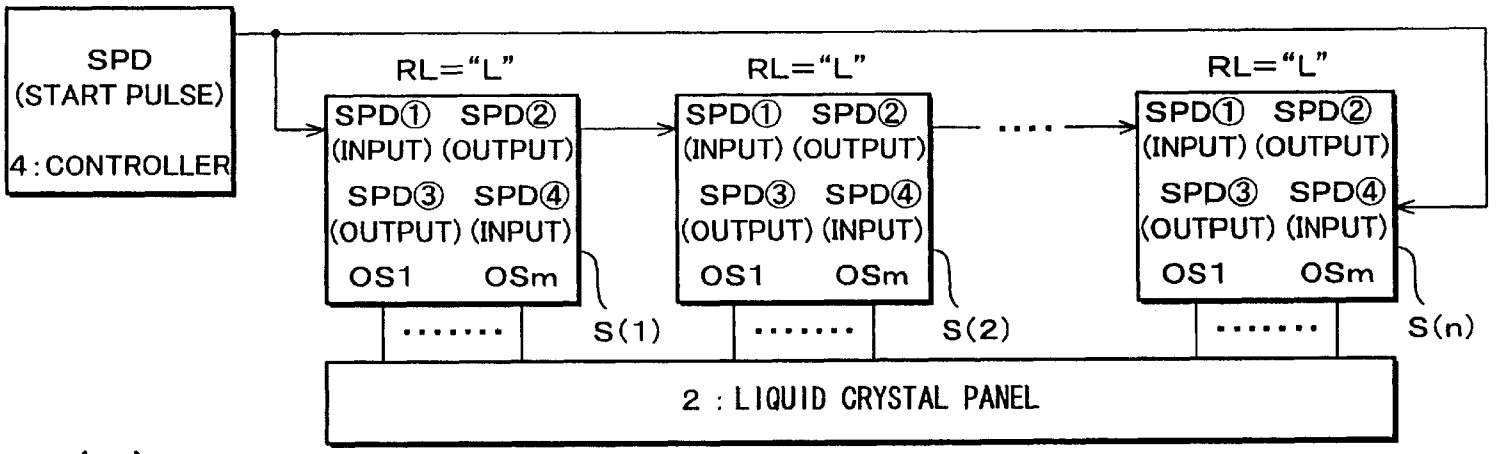
FIG. 11(*a*) is a block diagram showing transfer paths of a start pulse signal through plural source drivers.
Figure 11:
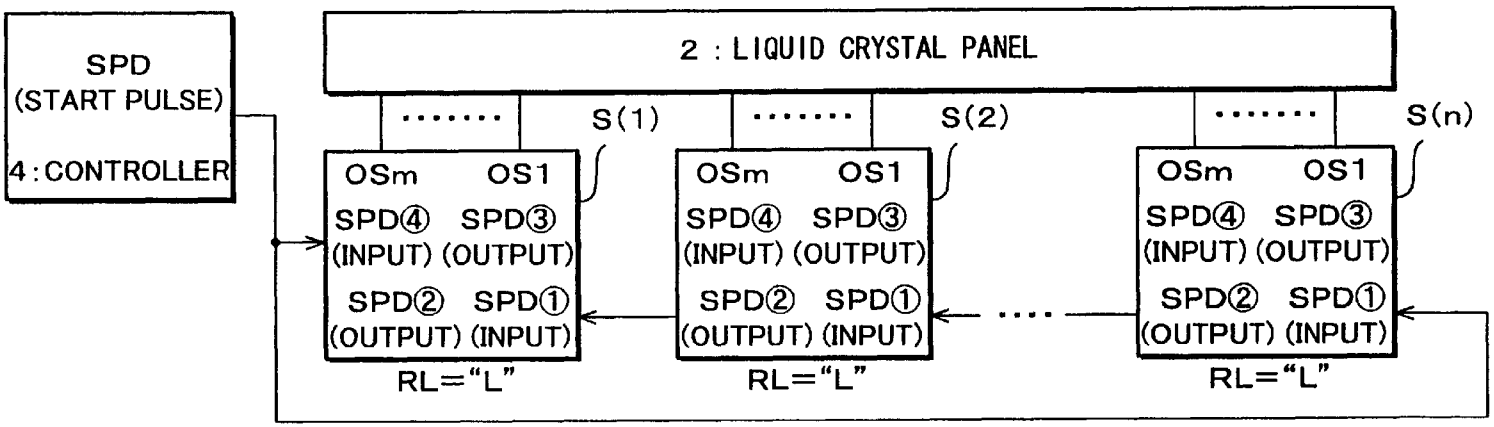

FIG. 11(*a*) shows a transfer direction of the start pulse signal SPD when the switch signal RL is at "Low" level in the arrangement of FIG. 8. By setting the switch signal RL at "Low" level, the start pulse signal SPD from the controller 4 is inputted from the input terminal SPD① of the first source driver S(1), and by being transferred through the bidirectional shift register 60 provided therein, it is outputted from the output terminal SPD② to be inputted into the input terminal SPD① of the source driver S(2) on the next stage. The start pulse signal SPD is subsequently transferred until it reaches the output terminal SPD② of the nth source driver S(n), which is on the last stage of the transfer direction. The output terminal SPD② of the nth source driver S(n) on the last stage has a free end.

FIG. 11(*b*) differs from FIG. 11(*a*) only with regard to the position where the group of source drivers S are provided with respect to the liquid crystal panel 2 (whether they are on the upper or lower side of the liquid crystal panel 2), or the position where the controller 4 is provided while the position of the group of source drivers S with respect to the liquid crystal panel 2 remains the same.

In FIG. 11(*b*), the switch signal RL is also at "Low" level, and the start pulse signal SPD is inputted from the input terminal SPD① of the nth source driver S(n), and by being transferred through the bidirectional shift register 60 provided therein, it is outputted from the output terminal SPD② to be inputted into the input terminal SPD① of the source driver S(n−1) on the next stage. The start pulse signal SPD is subsequently transferred in the same manner until it reaches the output terminal SPD② of the first source driver S(1), which is on the last stage of the transfer direction. The output terminal SPD② of the first source driver S(1) on the last stage has a free end.

Figure 12:
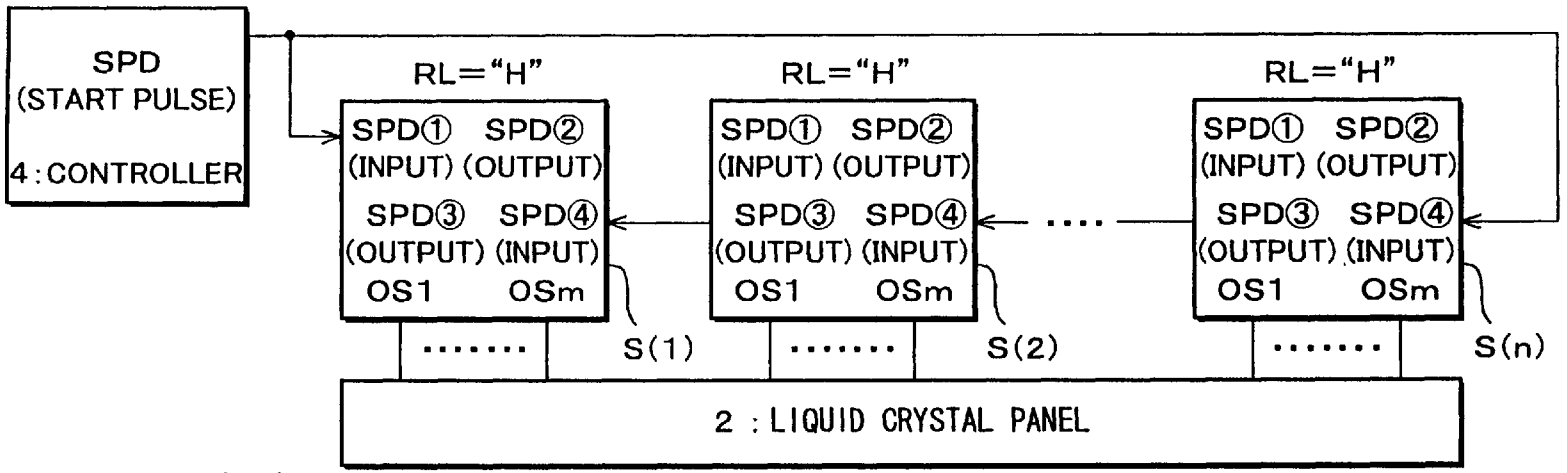
FIG. 12(*a*) is a block diagram showing transfer paths of a start pulse signal through plural source drivers.
Figure 12:
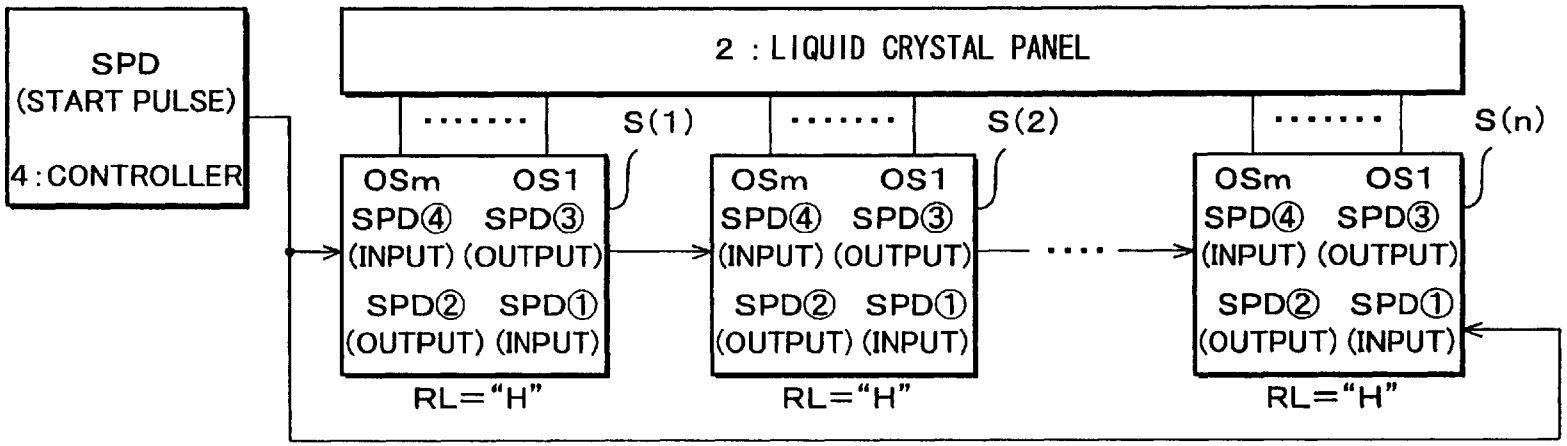

In FIGS. 12(*a*) and 12(*b*), the switch signal RL is at "High" level, and the shift direction of the bidirectional shift register 60 is reversed from that of FIGS. 11(*a*) and 11(*b*).

In FIG. 12(*a*), the start pulse signal SPD is inputted from the input terminal SPD④ of the nth source driver S(n), and by being transferred through the bidirectional shift register 60 provided therein, it is outputted from the output terminal SPD③ to be inputted into the input terminal SPD③ of the source driver S(n−1) of the next stage. The start pulse signal SPD is subsequently transferred until it reaches the output terminal SPD③ of the first source driver S(1), which is on the last stage of the transfer direction. The output terminal SPD③ of the first source driver S(1) on the last stage has a free end.

FIG. 12(*b*) differs from FIG. 12(*a*) only with regard to the position where the group of source drivers are provided with respect to the liquid crystal panel 2 (whether they are on the upper side or lower side of the liquid crystal panel 2), or the position of the controller 4 while the position of the group of source drivers S with respect to the controller 4 remains the same.

In FIG. 12(*b*), the start pulse signal SPD is inputted from the input terminal SPD④ of the source driver S(1) of the first stage, and by being transferred through the bidirectional shift register 60 provided therein, it is outputted form the output terminal SPD③ to be inputted into the input terminal SPD④ of the source driver S(2) on the next stage. The start pulse signal SPD is subsequently transferred in the same manner until it reaches the output terminal SPD③ of the nth source driver S(n), which is on the last stage of the transfer direction. The output terminal SPD③ of the nth source driver S(n) of the last stage has a free end.

Figure 13:
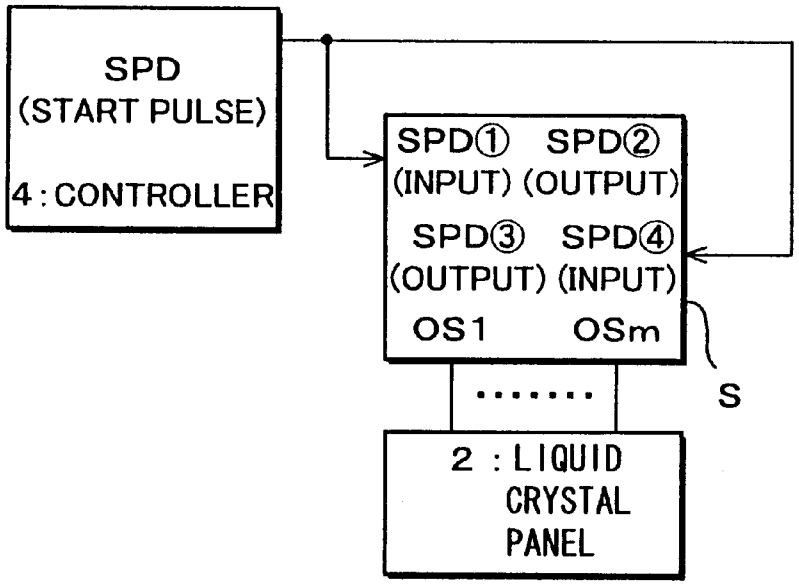
FIG. 13(*a*) is a block diagram showing transfer paths of a start pulse signal through a single source driver.
Figure 13:
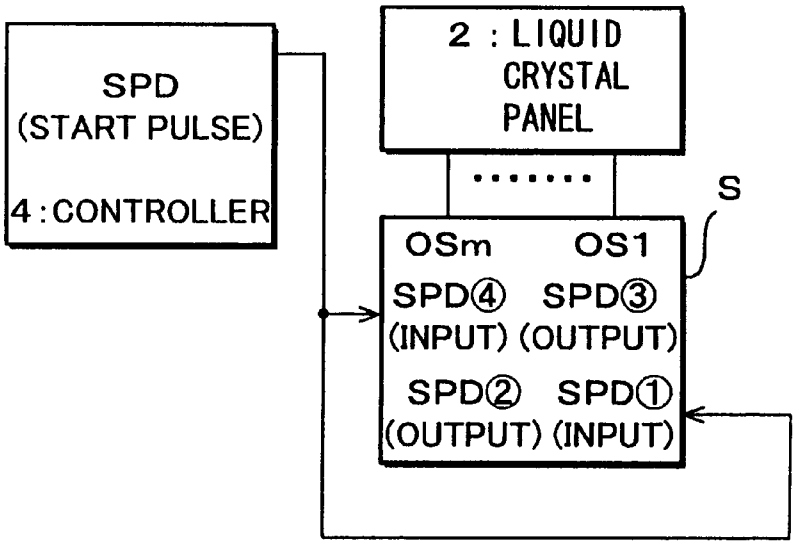

FIGS. 13(*a*) and 13(*b*) show an example of the display driving device which adopts the single source driver S as shown in FIG. 9. FIG. 13(*a*) and FIG. 13(*b*) are different from each other in the position where the source driver S is provided with respect to the liquid crystal panel 2, and in the position where the controller 4 is provided. When the switch signal RL is at "Low" level, the start pulse signal SPD is inputted from the input terminal SPD① to be transferred, and when the switch signal RL is at "High" level, the start pulse signal SPD is inputted from the input terminal SPD④. The output terminals SPD② and SPD③ of FIGS. 13(*a*) and 13(*b*) have a free end.

As described, with this arrangement, compared with the First Embodiment, because the set signals SEL1 and SEL2 are not required, it is not required to provide patterns for the set signals SEL1 and SEL2 on the TCP1 mounting the source driver S, thus simplifying the arrangement and making designing of TCP 1 easier.

Note that, the effect as obtained by the arrangement in which a single supply line is used for the start pulse signal for the group of source drivers, and in which this supply line is branched to be supplied to the input terminals at the both ends of the serially connected source drivers S is the same as that described in the First Embodiment.

Further, the First and Second Embodiments described the case where the source driver is used as the driving semiconductor element of the display driving device. As such, the start pulse signal SPD in this case is a horizontal synchronize signal for carrying out display on the liquid crystal panel 2, or a signal which is made out of the horizontal synchronize signal.

Further, as mentioned earlier, the present invention is also applicable to a gate driver which is provided with a bidirectional shift register and which transfers the start pulse signal. In such a case, the start pulse signal SPD supplied from the controller 4 is a vertical synchronize signal for carrying out display on the liquid crystal panel 2, or a signal which is made out of a vertical synchronize signal.

As described, a first display driving device of the present invention, which includes a plurality of serially connected driving semiconductor elements and which can switch a transfer direction of the start pulse signal has an arrangement in which there is provided only a single supply line for an externally supplied start pulse signal, and this single supply line of the start pulse signal is branched into two systems to be respectively connected to input terminals of the start pulse signal of driving semiconductor elements at the both ends of the group of serially connected driving semiconductor elements, and one of the two systems of the start pulse signal is made conductive while the other is made non-conductive within the group of driving semiconductor elements.

With this arrangement, there is provided only a single supply line for an externally supplied start pulse signal, and this single supply line is branched into two systems to be respectively connected to input terminals of the start pulse signal of driving semiconductor elements at the both ends of the group of serially connected driving semiconductor elements so as to conduct only one of the start pulse signals in the group of driving semiconductor elements.

Thus, it is possible to provide a display driving device which can switch the transfer direction of the start pulse signal without the conventional switching operation between conductive and non-conductive states by the provision of means such as analog switches on the side of the controller which inputs a control signal and other signals to the group of driving semiconductor elements.

Further, by setting a transfer direction of the start pulse signal in accordance with a transfer direction of a data signal, as described above, the same driving semiconductor elements can be mounted either on the upper side or lower side of the liquid crystal panel, and also the controller can be mounted either on the right side or left side of the driving semiconductor elements, regardless of whether the driving semiconductor elements are mounted on the upper side or lower side of the liquid crystal panel. Thus, because one kind of driving semiconductor elements can be positioned variably, the cost of driving semiconductor elements can be reduced.

Further, in this case, because the arrangement in which the transfer direction of the start pulse signal is switchable can be realized with less number of circuits on the side of the controller and less number of semiconductor device terminals to be provided on the side of the controller as compared with the conventional arrangement, the size and cost of the liquid crystal module can be further reduced.

Furthermore, because only a single line is required for the wiring between the controller and the group of driving semiconductor elements, compared with the conventional arrangement in which two lines were provided, in addition to reducing the size of the liquid crystal module, the adverse effect of noise can be reduced by widening the pitch of the wiring pattern which became narrow by the reduction in size of the liquid crystal module. Further, because only a single line is required for the wiring from the controller, there will be no change in wiring pattern due to a positioning relationship between the controller and the group of driving semiconductor elements, thus making designing of the module easier.

A second display driving device of the present invention, which includes a single driving semiconductor element having a bidirectional shift register and which can switch the transfer direction of the start pulse signal has an arrangement in which there is provided only a single supply line for the externally supplied start pulse signal, and this single supply line of the start pulse signal is branched into two systems to be respectively connected to the input terminals of the start pulse signal at the both ends of the driving semiconductor element, and one of the two systems of the start pulse signal is made conductive while the other is made non-conductive within the driving semiconductor element.

Even though the display driving device having the above arrangement incorporates only a single driving semiconductor element, by providing a single supply line for the start pulse signal, the same functions and effects as that of the first display driving device having a plurality of driving semiconductor elements cab be obtained.

A third display driving device of the present invention, which includes a plurality of serially connected driving semiconductor elements having a bidirectional shift register, and which includes an input/output buffer capable of switching input and output by an externally supplied switch signal, and which can switch the transfer direction of the start pulse signal has an arrangement in which the start pulse signal is supplied to both of the connected terminals of an input terminal of a start pulse signal of a driving semiconductor element on the first stage with respect to the transfer direction of the data signal and an output terminal of the start pulse signal of the driving semiconductor element on the last stage with respect to the transfer direction of the data signal, and a signal is prevented from being outputted from the output terminal of the start pulse signal of the driving semiconductor element on the last stage.

With this arrangement, the input terminal of the start pulse signal of the driving semiconductor element on the first stage with respect to the transfer direction of the data signal is connected to the output terminal of the start pulse signal of the driving semiconductor element on the last stage, and the start pulse signal is supplied to both of these connected terminals. In this case, by simply connecting the input terminal of the start pulse signal of the driving semiconductor element on the first stage and the output terminal of the start pulse signal of the driving semiconductor element on the last stage, there occurs a collision of start pulse signals. However, with the described arrangement, this is not a problem since a signal is prevented from being outputted from the input/output buffer of the output terminal of the start pulse signal of the driving semiconductor element on the last stage.

Thus, as with the first display driving device, the functions and effects of the single supply line of the start pulse signal can be obtained.

Incidentally, signal output from the output terminal of the start pulse signal of the driving semiconductor element on the last stage can also be prevented, for example, by cutting the output line. However, in such a case, the TCP pattern, etc., may need to be changed when changing the transfer direction of the start pulse signal or depending on the position of the controller with respect to the group of source drivers (group of driving semiconductor elements), and as a result the cost is increased and the convenience of liquid crystal module designing suffers.

Thus, the arrangement in which signal output from the output terminal of the start pulse signal of the driving semiconductor element on the last stage is prevented is preferably arranged such that the output buffer circuit of the input/output buffer of the output terminal sets the output terminal at "High" impedance state. With this arrangement, the operation of the output buffer circuit can be controlled with the use of a power voltage as a set signal of a logic gate provided in the output buffer circuit within the driving semiconductor elements, and thus this arrangement has the following advantages.

First, a "High" impedance state can easily be brought about only by adding a set signal compatible circuit in a conventional input/output buffer. This only results in minute increase in number of circuit elements and can be realized with ease and the chip area will not be increased. Further, because it can be realized only by changing the TCP pattern, only one kind of driving semiconductor element is required, and it is cost efficient. Further, switching can easily be made only by inputting a power (VCC, GND) level, allowing a simple arrangement. Furthermore, because the arrangement can easily be realized by internal circuits without requiring external circuits, it has the advantage of reliability and manufacturing cost.

A fourth display driving device of the present invention, which includes a single driving semiconductor element having a bidirectional shift register, and which includes an input/output buffer which can switch input and output by an externally supplied switch signal on each of input and output terminals of the start pulse signal of the driving semiconductor element, and which can switch the transfer direction of the start pulse signal has an arrangement in which the start pulse signal is supplied to both of the connected terminals of an input terminal of the start pulse signal of a driving semiconductor element on a first stage with respect to a transfer direction of a data signal and an output terminal of the start pulse signal of a driving semiconductor element on a last stage with respect to the transfer direction of the data signal, and a signal is prevented from being outputted from the output terminal of the start pulse signal of the driving semiconductor element on the last stage.

Even though the display driving device having the above arrangement incorporates only a single driving semiconductor element, by having the same arrangement as that of the third display driving device, the same functions and effects as that of the third display driving device can be obtained.

A fifth display driving device of the present invention which includes a plurality of serially connected driving semiconductor elements having a bidirectional shift register, and which can change the transfer direction of the start pulse signal has an arrangement in which two systems of input and output terminals of the start pulse signal are provided for each driving semiconductor element, and a single supply line for externally supplying the start pulse signal is connected to each of the input terminals of the start pulse signal of driving semiconductor elements at the both ends of the group of driving semiconductor elements by being branched into two systems.

With this arrangement, there are provided two systems of input and output terminals of the start pulse signal for each driving semiconductor element, and a supply line of the start pulse signal is connected to each of the input terminals of the start pulse signal of the driving semiconductor elements at the both ends of the group of serially connected driving semiconductor elements.

Thus, as with the first display driving device, the functions and effects of a single supply line of the start pulse signal can be obtained.

Further, with this arrangement, only one of the start pulse signals inputted into the group of driving semiconductor elements from the both ends is conducted, and the output terminal of the driving semiconductor element on the last stage of the transfer direction has an free end, and therefore unlike the third display driving device, it is not required to control the operation of the input/output buffer. As a result, a signal line or other lines for controlling the operation of the input/output buffer is not required, thus making designing of TCP, etc., mounting the driving semiconductor elements easier.

Further, a sixth display driving device of the present invention which includes a single driving semiconductor element having a bidirectional shift register, and which can change the transfer direction of the start pulse signal has an arrangement in which there are provided two systems of input and output terminals of the start pulse signal on the driving semiconductor element, and a single supply line of an externally supplied start pulse signal is connected to each input terminal of the start pulse signal of the driving semiconductor element by being branched into two systems.

Even though the display driving device having the above arrangement incorporates only a single driving semiconductor element, by having the same arrangement as that of the third display driving device, the same functions and effects as that of the fifth display driving device can be obtained.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A display driving device, comprising:

a group of driving semiconductor elements including a bidirectional shift register and made up of a plurality of serially connected driving semiconductor elements; and a single supply line which is branched into two systems for supplying an externally supplied start pulse signal to each driving semiconductor element, wherein the two systems of the branched single supply line are respectively connected to input terminals of the start pulse signal of driving elements at the both ends of the group of driving semiconductor elements, and a transfer direction of the start pulse signal is switched with the single supply line by making one of the two systems of the start pulse signal conductive while making the other non-conductive within the group of driving semiconductor elements.

2. The display driving device as set forth in claim 1, further comprising:

an input/output buffer provided for each of input and output terminals of the start pulse signal of each driving semiconductor element, wherein conduction/non-conduction of the two systems of the start pulse signal is switched by controlling an operation of the input/output buffer in accordance with a transfer direction of a data signal.

3. The display driving device as set forth in claim 1, wherein a transfer direction of the start pulse signal is set in accordance with a transfer direction of a data signal.

4. A liquid crystal module having the display drivig device claim 1.

5. A display driving device, comprising:

a single driving semiconductor element including a bidirectional shift register; and a single supply line which is branched into two systems for supplying an externally supplied start pulse signal to the driving semiconductor element, wherein the two systems of the branched start pulse signal are respectively connected to input terminals of the start pulse signal at the both ends of the driving semiconductor element, and a transfer direction of the start pulse signal is switched with the single supply line by making one of the two systems of the start pulse signal conductive while making the other non-conductive within the driving semiconductor element.

6. The display driving device as set forth in claim 5, wherein the transfer direction of the start pulse signal is set in accordance with a transfer direction of a data signal.

7. A liquid crystal module having the display driving device of claim 5.

8. A display driving device which is capable of switching a transfer direction of a start pulse signal, comprising:

a group of driving semiconductor elements including a bidirectional shift register and made up of a plurality of serially connected driving semiconductor elements; and an input/output buffer which is provided for each of input and output terminals of the start pulse signal of each driving semiconductor element, and which is capable of switching input and output by an externally supplied switch signal, wherein the start pulse sign is supplied to both of connected terminals of an input terminal of the start pulse signal of a driving semiconductor element on a first stage with respect to a transfer direction of a data signal and an output terminal of the start pulse signal of a driving semiconductor element on a last stage with respect to the transfer direction of the data signal, and a signal is prevented from being outputted from the output terminal of the start pulse signal of the driving semiconductor element on the last stage.

9. The display driving device as set forth in claim 8, wherein an output buffer circuit of the input/output buffer of the output terminal of the start pulse signal of the driving semiconductor element on the last stage prevents signal output by setting the output terminal at high impedance state.

10. The display driving device as set forth in claim 9, wherein an operation state of the output buffer circuit of the input/output buffer is controlled by a set signal, which is a signal level of a power line.

11. The display driving device as set forth in claim 8, wherein the transfer direction of the start pulse signal is set in accordance with the transfer direction of the data signal.

12. A liquid crystal module having the display driving device of claim 8.

13. A display driving device which is capable of switching a transfer direction of a start pulse signal, comprising:

a single driving semiconductor element including a bidirectional shift register; and an input/output buffer, which is provided for each of input and output terminals of the start pulse signal of the driving semiconductor element, and which is capable of switching input and output by an externally supplied switch signal, wherein the input and output terminals of the start pulse signal of the driving semiconductor element are connected to each other, and the start pulse signal is supplied to both of the input and output terminals, and a signal is prevented from being outputted from the input/output buffer of one of the terminals to be an output terminal of the start pulse signal with respect to a transfer direction of a data signal.

14. The display driving device as set forth in claim 13, wherein an operation state of an output buffer circuit of the input/output buffer is controlled by a set signal, which is a signal level of a power line.

15. The display driving device as set forth in claim 13, wherein the transfer direction of the start pulse signal is set in accordance with the transfer direction of the data signal.

16. A liquid crystal module having the display driving device of claim 13.

* * * * *